US011336058B2

(12) United States Patent
Liptak et al.

(10) Patent No.: US 11,336,058 B2
(45) Date of Patent: May 17, 2022

(54) SHIELDED CABLE ASSEMBLY

(71) Applicant: Aptiv Technologies Limited, St. Michael (BB)

(72) Inventors: Nicole L. Liptak, Cortland, OH (US); Bruce D. Taylor, Cortland, OH (US); Richard J. Boyer, Mantua, OH (US)

(73) Assignee: APTIV TECHNOLOGIES LIMITED

( * ) Notice: Subject to any disclaimer, the term of this patent is extended or adjusted under 35 U.S.C. 154(b) by 594 days.

(21) Appl. No.: 14/717,345

(22) Filed: May 20, 2015

(65) Prior Publication Data

US 2015/0255928 A1 Sep. 10, 2015

Related U.S. Application Data

(63) Continuation-in-part of application No. 14/101,472, filed on Dec. 10, 2013, now abandoned, and a (Continued)

(51) Int. Cl.
*H01B 11/06* (2006.01)
*H01R 13/6581* (2011.01)
(Continued)

(52) U.S. Cl.
CPC ..... *H01R 13/6581* (2013.01); *H01B 7/0216* (2013.01); *H01B 11/002* (2013.01);
(Continued)

(58) Field of Classification Search
CPC ..... H01R 13/6581; H01R 13/6592; H01R 13/6473; H01R 9/035; H01B 7/0216;
(Continued)

(56) References Cited

U.S. PATENT DOCUMENTS 4,453,798 A 6/1984 Asick et al.
5,015,800 A * 5/1991 Vaupotic ..... H01B 11/002 156/51
(Continued)

FOREIGN PATENT DOCUMENTS

CN 2779176 Y 12/2004
CN 102148447 A 8/2011
(Continued)

OTHER PUBLICATIONS

Machine Translation of CN 202134270.

*Primary Examiner* — Paresh Paghadal
(74) *Attorney, Agent, or Firm* — Billion & Armitage

(57) ABSTRACT

A shielded cable assembly capable of transmitting signals at speeds of 3.5 Gigabits per second (Gb/s) or higher without modulation or encoding over a single pair of conductors. The cable has a characteristic impedance of 95 Ohms and can support transmission data according to either USB 3.0 or HDMI 1.4 performance specifications. The wire cable includes a pair of conductors, a shield surrounding the conductors, and a dielectric structure configured to maintain a first predetermined spacing between the conductors and a second predetermined spacing between said conductors and said shield. The shield includes an inner shield conductor enclosing the dielectric structure and an outer shield conductor enclosing the inner shield conductor.

15 Claims, 28 Drawing Sheets

Related U.S. Application Data continuation-in-part of application No. 13/804,245, filed on Mar. 14, 2013, now abandoned.

(51) Int. Cl.

| | |
|---|---|
| ***H01B 7/02*** | (2006.01) |
| ***H01B 11/00*** | (2006.01) |
| ***H01B 11/10*** | (2006.01) |
| *H01R 13/6592* | (2011.01) |
| *H01B 7/18* | (2006.01) |

(52) U.S. Cl.
CPC ..... *H01B 11/06* (2013.01); *H01B 11/1033* (2013.01); *H01B 7/1875* (2013.01); *H01B 11/1091* (2013.01); *H01R 13/6592* (2013.01)

(58) Field of Classification Search
CPC H01B 7/1875; H01B 11/002; H01B 11/1091; H01B 11/06; H01B 11/1033
See application file for complete search history.

(56) References Cited

U.S. PATENT DOCUMENTS 5,414,215 A * 5/1995 Dunand ..... H01B 7/0009 174/109
5,483,020 A * 1/1996 Hardie ..... H01B 11/203 156/51
5,574,250 A * 11/1996 Hardie ..... H01B 11/005 174/102 R
5,606,151 A * 2/1997 Siekierka ..... H01B 11/002 174/110 R
5,734,126 A 3/1998 Siekierka et al.
5,904,595 A 5/1999 Tanigawa
6,010,788 A * 1/2000 Kebabjian ..... H01B 11/002 174/102 R
6,222,129 B1 * 4/2001 Siekierka ..... C08L 23/10 174/113 R
6,222,130 B1 4/2001 Gareis et al.
6,403,887 B1 * 6/2002 Kebabjian ..... H01B 11/002 174/110 R
6,441,308 B1 8/2002 Gagnon
6,504,379 B1 1/2003 Jackson
6,563,052 B2 * 5/2003 Groegl ..... H01B 11/1016 174/106 R
6,803,518 B2 * 10/2004 Chang ..... H01B 11/002 174/113 R
6,844,500 B2 * 1/2005 Williams ..... H01B 7/0823 174/110 R
7,323,640 B2 * 1/2008 Takahashi ..... H01B 11/002 174/106 R
7,432,446 B2 * 10/2008 Orfin ..... H01B 7/065 174/113 R
7,503,793 B2 3/2009 Morello
7,790,981 B2 9/2010 Vaupotic et al.
8,303,343 B2 11/2012 Nagata
8,981,216 B2 * 3/2015 Grant ..... H01B 11/06 174/36
9,543,059 B2 * 1/2017 Deighton ..... H01B 7/285
2003/0104727 A1 6/2003 Chen et al.
2004/0050582 A1 * 3/2004 Grogl ..... H01B 7/041 174/120 R
2004/0256139 A1 * 12/2004 Clark ..... H01B 11/002 174/110 R
2005/0029006 A1 * 2/2005 Takahashi ..... H01B 11/1033 174/102 R
2005/0121223 A1 * 6/2005 Wu ..... H01B 5/08 174/126.1
2005/0171263 A1 * 8/2005 Kanamori ..... C08L 23/12 524/430
2006/0048966 A1 * 3/2006 Takahashi ..... H01B 11/002 174/108
2006/0254805 A1 * 11/2006 Scherer ..... H01B 11/203 174/129 R
2007/0068697 A1 * 3/2007 Orfin ..... H01B 7/065 174/113 R
2008/0073105 A1 * 3/2008 Clark ..... H01B 7/0216 174/112
2008/0251277 A1 * 10/2008 Hopkinson ..... C08L 23/12 524/430
2011/0065304 A1 3/2011 Zhang
2011/0139485 A1 * 6/2011 Matsuda ..... H01B 11/002 174/102 R
2011/0232941 A1 * 9/2011 Sugiyama ..... H01B 11/203 174/250
2011/0252635 A1 10/2011 Kenny et al.
2011/0315419 A1 * 12/2011 Grant ..... H01B 11/06 174/34
2012/0090872 A1 * 4/2012 Gundel ..... H01B 7/0823 174/102 R
2012/0145429 A1 6/2012 Nordin et al.
2012/0186850 A1 * 7/2012 Sugiyama ..... H01B 11/1834 174/102 R
2012/0318557 A1 * 12/2012 Iwasaki ..... C08K 5/0025 174/113 C
2013/0072041 A1 * 3/2013 Nonen ..... H01R 13/65915 439/98
2013/0175081 A1 * 7/2013 Watanabe ..... H01B 11/18 174/363
2013/0264094 A1 * 10/2013 Gemmel ..... H01B 13/141 174/120 R
2014/0090868 A1 * 4/2014 Ohgushi ..... H01B 7/0275 174/110 R
2014/0138151 A1 * 5/2014 Islam ..... G02B 6/4471 174/71 R
2014/0262424 A1 9/2014 Liptak et al.
2015/0075838 A1 * 3/2015 Buck ..... H01B 7/303 174/103

FOREIGN PATENT DOCUMENTS

CN 102332337 A 1/2012
CN 202134270 U 2/2012
CN 103198888 A 7/2013
CN 104051072 A 9/2014
EP 1267362 A1 10/2004
JP H10069943 A 3/2003
JP 2003346566 * 12/2003 ..... H01B 11/02
JP 2010277967 A 12/2010

* cited by examiner

| STANDARD | RISE TIME | NOMINAL IMPEDANCE | MINIMUM IMPEDANCE | MAXIMUM IMPEDANCE |
|---|---|---|---|---|
| HDMI 1.4 | 200 ps (10-90%) | 100 Ω | 85 Ω | 115 Ω |
| USB 3.0 | 50 ps (20-80%) | 90 Ω | 76.5 Ω | 105 Ω |
| COMBINED | 50 ps (20-80%) | 95 Ω | 85 Ω | 105 Ω |

FIG. 9

| | | |
|---|---|---|
| DIELECTRIC STRENGTH | 100 VAC/MINUTE | |
| MAXIMUM DC RESISTANCE AT 20° C | 381Ω/km | |
| IMPEDANCE (TDR 50 ps (20-80%)) | 95 Ω | |
| INTRA-PAIR SKEW | < 50ps | |
| ATTENUATION/7 METERS | ≤ 1.5 DECIBELS(dB) | |
| DIFFERENTIAL INSERTION LOSS (dB @ FREQUENCY RANGE) | ≤ 1.5 dB | @ < 100 MEGAHERTZ (MHz) |
| | ≤ 5 dB | @ < 100 MHz - 1250 MHz |
| | ≤ 7.5 dB | @ < 1250 MHz - 2500 MHz |
| | ≤ 25 dB | @ < 2500 MHz - 7500 MHz |
| BENDING RADIUS | ≤ 10 x CABLE OD | |

FIG. 10

SHIELDED CABLE ASSEMBLY

CROSS-REFERENCE TO RELATED APPLICATION

This application is a continuation-in-part application and claims the benefit under 35 U.S.C. § 120 of U.S. patent application Ser. No. 14/101,472, filed Dec. 10, 2013 which itself is a continuation-in-part application that claims the benefit under 35 U.S.C. § 120 of U.S. patent application Ser. No. 13/804,245, filed Mar. 14, 2013, the entire disclosure of both of which are hereby incorporated herein by reference.

TECHNICAL FIELD OF INVENTION

The invention generally relates to shielded cable assemblies, and more particularly relates to a shielded cable assembly designed to transmit digital electrical signals having a data transfer rate of 3.5 Gigabits per second (Gb/s) or higher without modulation or encoding.

BACKGROUND OF THE INVENTION

The increase in digital data processor speeds has led to an increase in data transfer speeds. Transmission media used to connect electronic components to the digital data processors must be constructed to efficiently transmit the high speed digital signals between the various components. Wired media, such as fiber optic cable, coaxial cable, or twisted pair cable may be suitable in applications where the components being connected are in fixed locations and are relatively close proximity, e.g. separated by less than 100 meters. Fiber optic cable provides a transmission medium that can support data rates of up to nearly 100 Gb/s and is practically immune to electromagnetic interference. Coaxial cable supports data transfer rates up to 10 Gigabits per second (Gb/s) as digital data and has good immunity to electromagnetic interference. Twisted pair cable can support data rates above 5 Gb/s, although these cables typically require multiple twisted pairs within the cable dedicated to transmit or receive lines. The conductors of the twisted pair cables offer good resistance to electromagnetic interference which can be improved by including shielding for the twisted pairs within the cable.

Data transfer protocols such as Universal Serial Bus (USB) 3.0 and High Definition Multimedia Interface (HDMI) 1.4 require data transfer rates at or above 5 Gb/s. Existing coaxial cable cannot support data rates near this speed. Both fiber optic and twisted pair cables are capable of transmitting data at these transfer rates, however, fiber optic cables are fragile (requiring field service) and significantly more expensive than twisted pair, making them less attractive for cost sensitive applications that do not require the high data transfer rates and electromagnetic interference immunity.

Infotainment systems and other electronic systems in automobiles and trucks are beginning to require cables capable of carrying high data rate signals. Automotive grade cables must not only be able to meet environmental requirements (e.g. vibration, thermal age, moisture resistance, and EMC), they must also be flexible enough to be routed in a vehicle wiring harness and have a low mass to help meet vehicle fuel economy requirements. Therefore, there is a need for a wire cable with a high data transfer rate that has low mass and is flexible enough to be packaged within a vehicle wiring harness, while meeting cost targets that cannot currently be met by fiber optic cable. Although the particular application given for this wire cable is automotive, such a wire cable would also likely find other applications, such as aerospace, industrial control, or other data communications.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an assembly configured to transmit electrical signals is provided. The assembly includes a wire cable having a first inner conductor and second inner conductor, a shield surrounding the first inner conductor and the second inner conductor, and a dielectric structure configured to maintain a first predetermined spacing between the first inner conductor and the second inner conductor and a second predetermined spacing between the first inner conductor and the second inner conductor and the shield. The shield includes an inner shield conductor at least partially enclosing the dielectric structure, thereby establishing a characteristic impedance of the wire cable, and an outer shield conductor at least partially enclosing the inner shield conductor and in electrical communication with the inner shield conductor. The dielectric structure is configured to provide consistent radial spacing between the first and second inner conductor and the inner shield conductor.

The dielectric structure may include a first dielectric insulator enclosing the first inner conductor and a second dielectric insulator enclosing the second inner conductor. The first dielectric insulator and the second dielectric insulator may be bonded together, thereby providing consistent lateral spacing between the first inner conductor and the second inner conductor. The dielectric structure may further include a third dielectric insulator that encloses the first dielectric insulator and the second dielectric insulator to maintain transmission line characteristics and provide more consistent radial spacing between the first and second inner conductor and the inner shield conductor.

The inner shield conductor may be formed of an aluminized film wrapped about the dielectric structure such that a seam formed by the inner shield conductor is substantially parallel to a longitudinal axis of the wire cable. A lateral length of the inner shield conductor covers at least 100 percent of a dielectric structure circumference. The assembly may not include a separate drain wire conductor.

The assembly having a wire cable up to 7 meters in length may be characterized as having a differential insertion loss of less than 1.5 decibels (dB) for a signal with signal frequency content less than 100 Megahertz (MHz), less than 5 dB for a signal with signal frequency content between 100 MHz and 1.25 Gigahertz (GHz), less than 7.5 dB for a signal with signal frequency content between 1.25 GHz and 2.5 GHz, and less than 25 dB for a signal with signal frequency content between 2.5 GHz and 7.5 GHz. The assembly may be characterized as having an intra-pair skew of less than 50 picoseconds.

The assembly may further include at least one electrical connector. The connector may be a plug connector having a first plug terminal including a first connection portion characterized by a generally rectangular cross section, and a second plug terminal including a second connection portion characterized by a generally rectangular cross section. The first and second plug terminals are configured to be attached to the first and second inner conductor respectively. The first and second plug terminals form a mirrored pair having bilateral symmetry about a longitudinal axis. The plug connector may include a plug shield electrically isolated from the plug connector and longitudinally surrounding the plug connector.

Alternatively, the electrical connector may be a receptacle connector configured to mate with the plug connector and having a first receptacle terminal including a first cantilever beam portion characterized by a generally rectangular cross section and defining a convex first contact point depending from the first cantilever beam portion, the first contact point configured to contact the first connection portion of the first plug terminal and a second receptacle terminal including a second cantilever beam portion characterized by a generally rectangular cross section and defining a convex second contact point depending from the second cantilever beam portion, the second contact point configured to contact the second connection portion of the second plug terminal. The first and second receptacle terminals are configured to be attached to the first and second inner conductor respectively. The first and second receptacle terminals form a mirrored terminal pair having bilateral symmetry about the longitudinal axis. When a plug connector is connected to a corresponding receptacle connector, the major width of the first connection portion is substantially perpendicular to the major width of the first cantilever beam portion and the second connection portion is substantially perpendicular to the major width of the second cantilever beam portion. The receptacle connector may include a receptacle shield electrically isolated from the receptacle connector and longitudinally surrounding the receptacle connector.

The plug shield and/or the receptacle shield may define a pair of wire crimping wings that are mechanically connected to the outer shield conductor, thereby electrically connecting the shield to the inner shield conductor, thereby establishing the characteristic impedance of the assembly. The receptacle shield may define an embossment proximate a location of a connection between the first inner conductor and the first receptacle terminal and a connection between the second inner conductor and the second receptacle terminal.

The plug shield and/or the receptacle shield may define a prong that is configured to penetrate the dielectric structure, thereby inhibiting rotation of the electrically conductive shield about the longitudinal axis.

The assembly may further include at least one connector body. The connector body may be a plug connector body defining a first cavity. The plug connector and the plug shield are at least partially disposed within the first cavity. Alternatively, the connector body may be a receptacle connector body defining a second cavity and configured to mate with the plug connector body. The receptacle connector and the receptacle shield are at least partially disposed within the second cavity. The plug shield and/or the receptacle shield may define a triangular protrusion configured to secure the shield within the connector body.

The plug connector body may define a longitudinally extending lock arm that is integrally connected to the plug connector body. The lock arm includes a U-shaped resilient strap integrally connecting the lock arm to the plug connector body, an inwardly extending lock nib configured to engage an outwardly extending lock tab defined by the receptacle connector body, and a depressible handle disposed rearward of the U-shaped resilient strap. The lock nib is moveable outwardly away from the lock tab to enable disengagement of the lock nib with the lock tab. An inwardly extending fulcrum located on the lock arm between the lock nib and the depressible handle. A free end of the lock arm defines an outwardly extending stop. A transverse hold down beam is integrally connected to the plug connector body between fixed ends and configured to engage the stop and increase a hold-down force on the lock nib to maintain engagement of the lock nib with the lock tab when a longitudinal force applied between the plug connector body and the receptacle connector body exceeds a first threshold. The plug connector body further defines a shoulder configured to engage the U-shaped resilient strap and increase the hold-down force on the lock nib to maintain the engagement of the lock nib with the lock tab when the longitudinal force applied between the plug connector body and the receptacle connector body exceeds a second threshold.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which:

FIG. 9 is a chart illustrating the signal rise time and desired cable impedance of several high speed digital transmission standards;

FIG. 10 is a chart illustrating various performance characteristics of the wire cable of FIGS. 1-7 in accordance with several embodiments.

DETAILED DESCRIPTION OF THE INVENTION

Presented herein is a wire cable assembly that is capable of carrying digital signals at rates up to 5 Gigabits per second (Gb/s) (5 billion bits per second) to support both USB 3.0 and HDMI 1.4 performance specifications. The wire cable assembly includes a wire cable having a pair of conductors (wire pair) and a conductive sheet and braided conductor to isolate the wire pair from electromagnetic interference and determine the characteristic impedance of the cable. The wire pair is encased within dielectric belting to maintain transmission line characteristics and provide a consistent radial distance between the wire pair and the shield. The belting also sustains a consistent twist lay length between the wire pair if they are twisted. The consistent radial distance between the wire pair and the shield and the consistent twist lay length provides a wire cable with controlled impedance. The wire cable assembly may also include an electrical receptacle connector having a mirrored pair of receptacle terminals connected to the wire pair and an electrical plug connector having a mirrored pair of plug terminals connected to the wire pair. The receptacle and plug terminals each have a generally rectangular cross section and when the first and second electrical connectors are mated, the major widths of the receptacle terminals are substantially perpendicular to the major widths of the plug terminals and the contact points between the receptacle and plug terminals are external to the receptacle and plug terminals. Both the receptacle and plug connectors include a shield that longitudinally surrounds the receptacle or plug terminals and is connected to the braided conductor of the wire cable. The wire cable assembly may also include an insulative connector body that contains the receptacle or plug terminals and shield.

Figure 1:
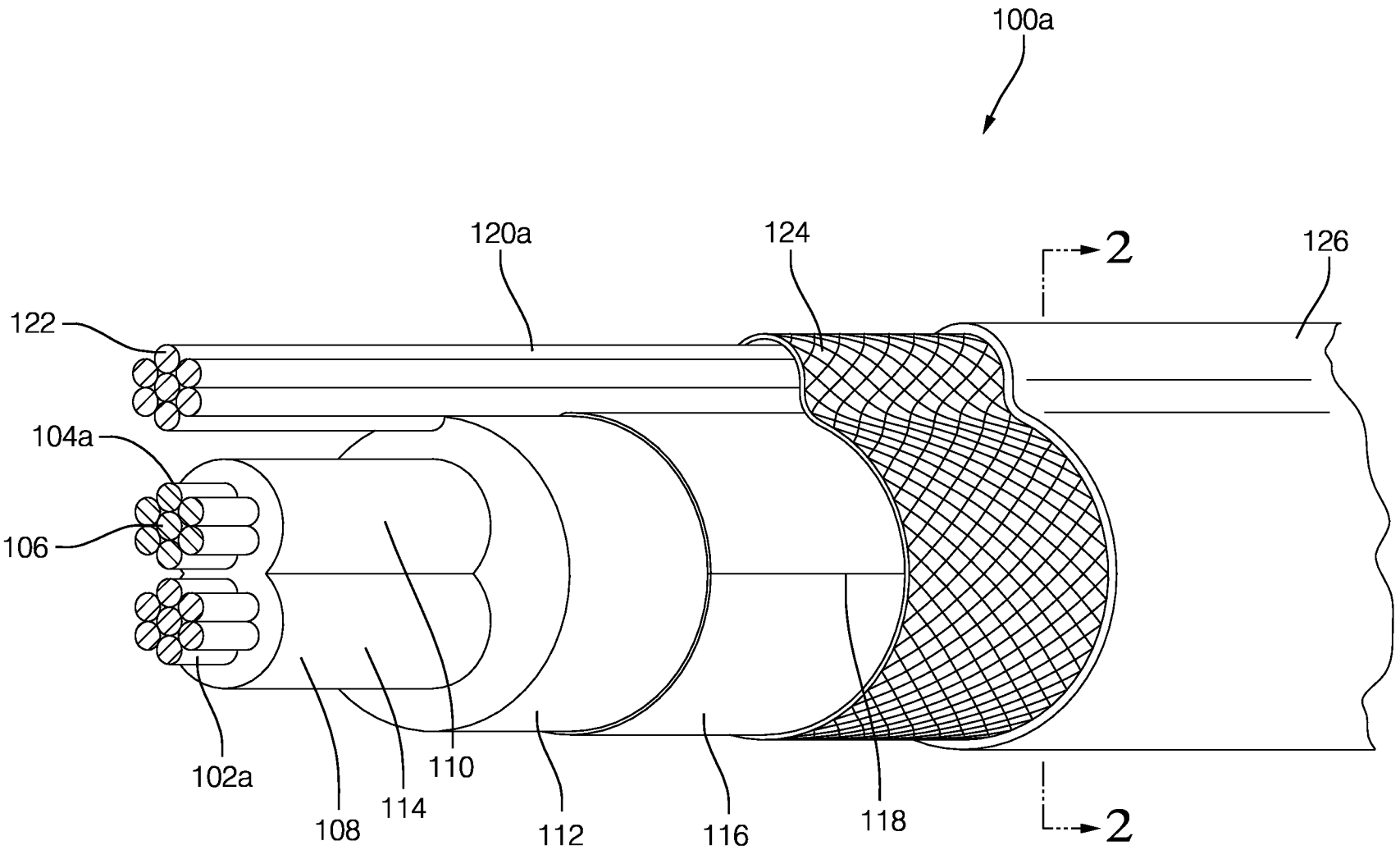
FIG. 1 is perspective cut away drawing of a wire cable of a wire cable assembly having stranded conductors in accordance with a first embodiment.
Figure 2:
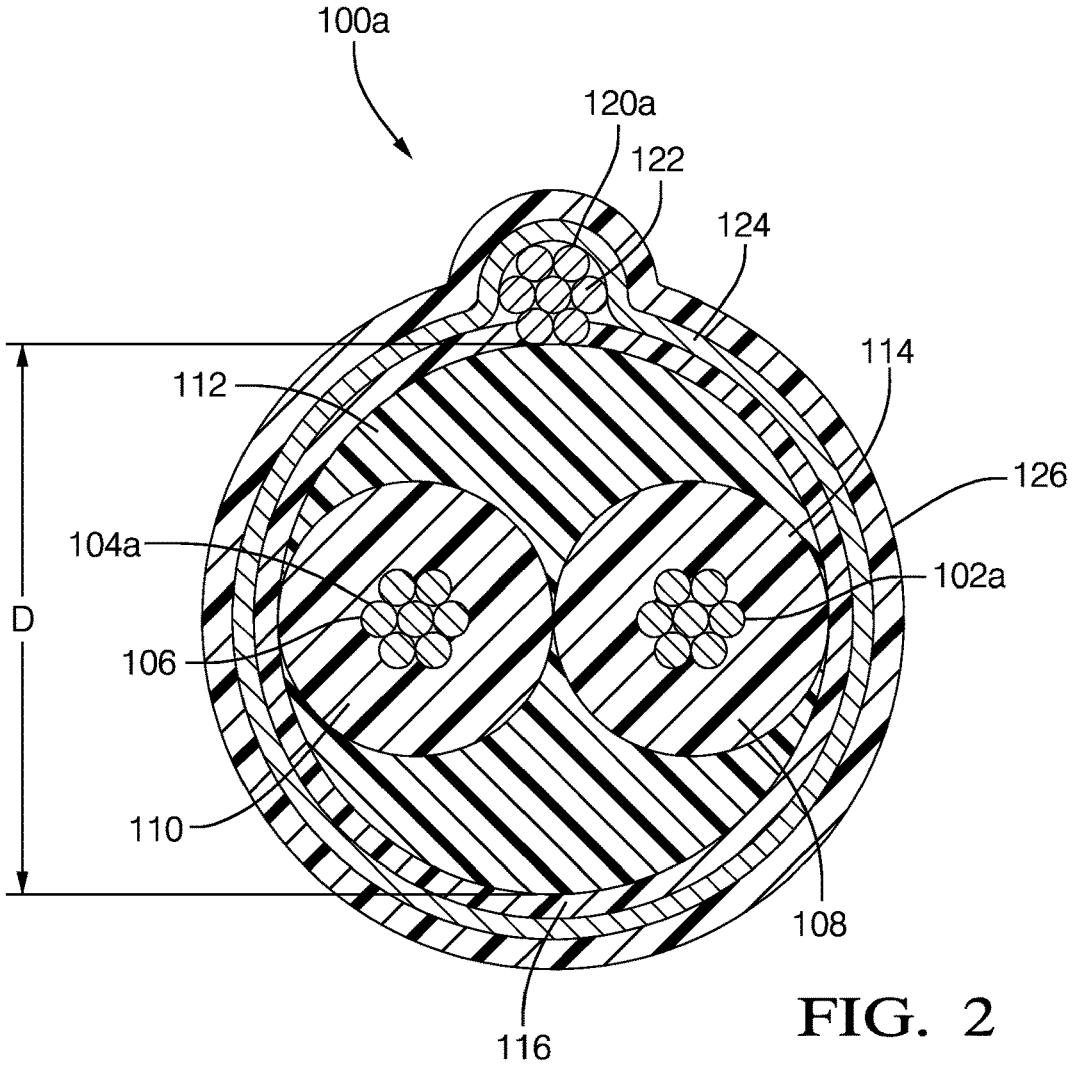
FIG. 2 is a cross section drawing of the wire cable of FIG. 1 in accordance with the first embodiment.

FIGS. 1 and 2 illustrate a non-limiting example of a wire cable 100*a* used in the wire cable assembly. The wire cable 100*a* includes a central pair of conductors comprising a first inner conductor, hereinafter referred to as the first conductor 102*a* and a second inner conductor, hereinafter referred to as the second conductor 104*a*. The first and second conductors 102*a*, 104*a* are formed of a conductive material with superior conductivity, such as unplated copper or silver plated copper. As used herein, copper refers to elemental copper or a copper-based alloy. Further, as used herein, silver refers to elemental silver or a silver-based alloy. The design, construction, and sources of copper and silver plated copper conductors are well known to those skilled in the art. In the example shown in FIGS. 1 and 2, the first and second conductors 102*a*, 104*a* of wire cable 100*a* may each consist of seven wire strands 106. Each of the wire strands 106 of the first and second conductors 102*a*, 104*a* may be characterized as having a diameter of 0.12 millimeters (mm). The first and second conductors 102*a*, 104*a* may be characterized as having an overall diameter of about 0.321 millimeters (mm), which is generally equivalent to 28 American Wire Gauge (AWG) stranded wire. Alternatively, the first and second conductors 102*a*, 104*a* may be formed of stranded wire having a smaller diameter, resulting in a smaller overall diameter equivalent to 30 AWG or 32 AWG.

As shown in FIG. 2, the central pair of first and second conductors 102*a*, 104*a* is longitudinally twisted over a lay length L, for example once every 15.24 mm. Twisting the first and second conductors 102*a*, 104*a* provides the benefit of reducing low frequency electromagnetic interference of the signal carried by the central pair. However, the inventors have discovered that satisfactory signal transmission performance may also be provided by a wire cable wherein the first and second conductors 102*a*, 104*a* are not twisted about one about the other. Not twisting the first and second conductors 102*a*, 104*a* may provide the benefit of reducing manufacturing cost of the wire cable by eliminating the twisting process.

Referring once more to FIGS. 1 and 2, each of the first and second conductors 102*a*, 104*a* are enclosed within a respective first dielectric insulator and a second dielectric insulator, hereafter referred to as the first and second insulators 108, 110. The first and second insulators 108, 110 are bonded together. The first and second insulators 108, 110 run the entire length of the wire cable 100*a*, except for portions that are removed at the ends of the cable in order to terminate the wire cable 100*a*. The first and second insulators 108, 110 are formed of a flexible dielectric material, such as polypropylene. The first and second insulators 108, 110 may be characterized as having a thickness of about 0.85 mm.

Figure 3:
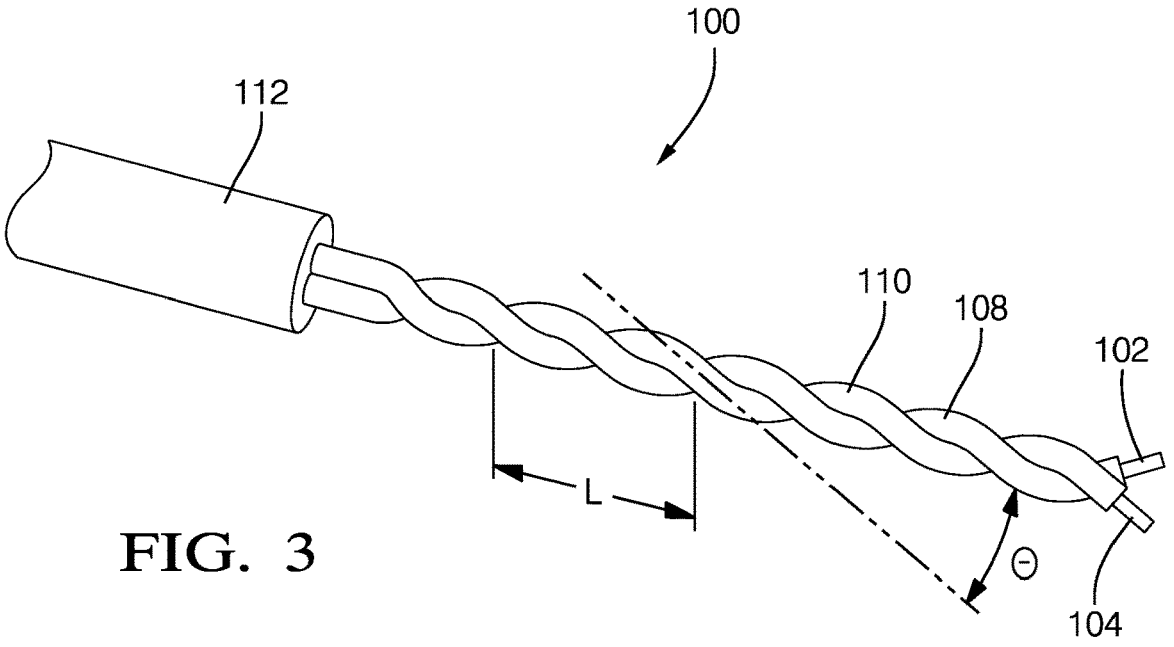
FIG. 3 is a partial cut away drawing of the wire cable illustrating the twist lay length of the wire cable of FIG. 1 in accordance with a second embodiment.

Bonding the first insulator 108 to the second insulators 110 helps to maintain the spacing between the first and second conductors 102*a*, 104*a*. It may also keep a consistent twist lay length (see FIG. 3) between the first and second conductors 102*a*, 104*a* consistent when the first and second conductors 102*a*, 104*a* are twisted. The methods required to manufacture a pair of conductors with bonded insulators are well known to those skilled in the art.

The first and second conductors 102*a*, 104*a* and the first and second insulators 108, 110 are completely enclosed within a third dielectric insulator, hereafter referred to as the belting 112, except for portions that are removed at the ends of the cable in order to terminate the wire cable 100*a*. The first and second insulators 108, 110 and the belting 112 together form a dielectric structure 113.

The belting 112 is formed of a flexible dielectric material, such as polyethylene. As illustrated in FIG. 2, the belting may be characterized as having a diameter D of 2.22 mm. A release agent 114, such as a talc-based powder, may be applied to an outer surface of the bonded first and second insulators 108, 110 in order to facilitate removal of the belting 112 from the first and second insulators 108, 110 when ends of the first and second insulators 108, 110 are stripped from the first and second conductors 102*a*, 104*a* to form terminations of the wire cable 100*a*.

The belting 112 is completely enclosed within a conductive sheet, hereafter referred to as the inner shield 116, except for portions that may be removed at the ends of the cable in order to terminate the wire cable 100*a*. The inner shield 116 is longitudinally wrapped in a single layer about the belting 112, so that it forms a single seam 118 that runs generally parallel to the central pair of first and second conductors 102*a*, 104*a*. The inner shield 116 is not spirally wrapped or helically wrapped about the belting 112. The seam edges of the inner shield 116 may overlap, so that the inner shield 116 covers at least 100 percent of an outer surface of the belting 112. The inner shield 116 is formed of a flexible conductive material, such as aluminized biaxially oriented PET film. Biaxially oriented polyethylene terephthalate film is commonly known by the trade name MYLAR and the aluminized biaxially oriented PET film will hereafter be referred to as aluminized MYLAR film. The aluminized MYLAR film has a conductive aluminum coating applied to only one of the major surfaces; the other major surface is non-aluminized and therefore non-conductive. The design, construction, and sources for single-sided aluminized MYLAR films are well known to those skilled in the art. The non-aluminized surface of the inner shield 116 is in contact with an outer surface of the belting 112. The inner shield 116 may be characterized as having a thickness of less than or equal to 0.04 mm.

The belting 112 provides the advantage of maintaining transmission line characteristics and providing a consistent radial distance between the first and second conductor 102*a*, 104*a* and the inner shield 116. The belting 112 further provides an advantage of keeping the twist lay length between the first and second conductors 102*a*, 104*a* consistent. Shielded twisted pair cables found in the prior art typically only have air as a dielectric between the twisted pair and the shield. Both the distance between first and second conductors 102*a*, 104*a* and the inner shield 116 and the effective twist lay length of the first and second conductors 102*a*, 104*a* affect the wire cable impedance. Therefore a wire cable with more consistent radial distance between the first and second conductors 102*a*, 104*a* and the inner shield 116 provides more consistent impedance. A consistent twist lay length of the first and second conductors 102*a*, 104*a* also provides controlled impedance.

Alternatively, a wire cable may be envisioned incorporating a single dielectric structure encasing the first and second insulators to maintain a consistent lateral distance between the first and second insulators and a consistent radial distance between the first and second insulators and the inner shield. The dielectric structure may also keep the twist lay length of the first and second conductors consistent.

As shown in FIGS. 1 and 2, the wire cable 100*a* additionally includes a ground conductor, hereafter referred to as the drain wire 120*a* that is disposed outside of the inner shield 116. The drain wire 120*a* extends generally parallel to the first and second conductors 102*a*, 104*a* and is in intimate contact or at least in electrical communication with the aluminized outer surface of the inner shield 116. In the example of FIGS. 1 and 2, the drain wire 120*a* of wire cable 100*a* may consist of seven wire strands 122. Each of the wire strands 122 of the drain wire 120*a* may be characterized as having a diameter of 0.12 mm, which is generally equivalent to 28 AWG stranded wire. Alternatively, the drain wire 120*a* may be formed of stranded wire having a smaller gauge, such as 30 AWG or 32 AWG. The drain wire 120*a* is formed of a conductive wire, such as an unplated copper wire or a tin plated copper wire. The design, construction, and sources of copper and tin plated copper conductors are well known to those skilled in the art.

As illustrated in FIGS. 1 and 2, the wire cable 100*a* further includes a braided wire conductor, hereafter referred to as the outer shield 124, enclosing the inner shield 116 and the drain wire 120*a*, except for portions that may be removed at the ends of the cable in order to terminate the wire cable 100*a*. The outer shield 124 is formed of a plurality of woven conductors, such as copper or tin plated copper. As used herein, tin refers to elemental tin or a tin-based alloy. The design, construction, and sources of braided conductors used to provide such an outer shield are well known to those skilled in the art. The outer shield 124 is in intimate contact or at least in electrical communication with both the inner shield 116 and the drain wire 120*a*. The wires forming the outer shield 124 may be in contact with at least 65 percent of an outer surface of the inner shield 116. The outer shield 124 may be characterized as having a thickness less than or equal to 0.30 mm.

The wire cable 100*a* shown in FIGS. 1 and 2 further includes an outer dielectric insulator, hereafter referred to as the jacket 126. The jacket 126 encloses the outer shield 124, except for portions that may be removed at the ends of the cable in order to terminate the wire cable 100*a*. The jacket 126 forms an outer insulation layer that provides both electrical insulation and environmental protection for the wire cable 100*a*. The jacket 126 is formed of a flexible dielectric material, such as polyvinyl chloride (PVC). The jacket 126 may be characterized as having a thickness of about 0.2 mm.

The wire cable 100*a* is constructed so that the inner shield 116 is tight to the belting 112, the outer shield 124 is tight to the drain wire 120*a* and the inner shield 116, and the jacket 126 is tight to the outer shield 124 so that the formation of air gaps between these elements is minimized or compacted. This provides the wire cable 100*a* with controlled magnetic permeability.

The wire cable 100*a* may be characterized as having a characteristic impedance of 95 Ohms.

Figure 4:
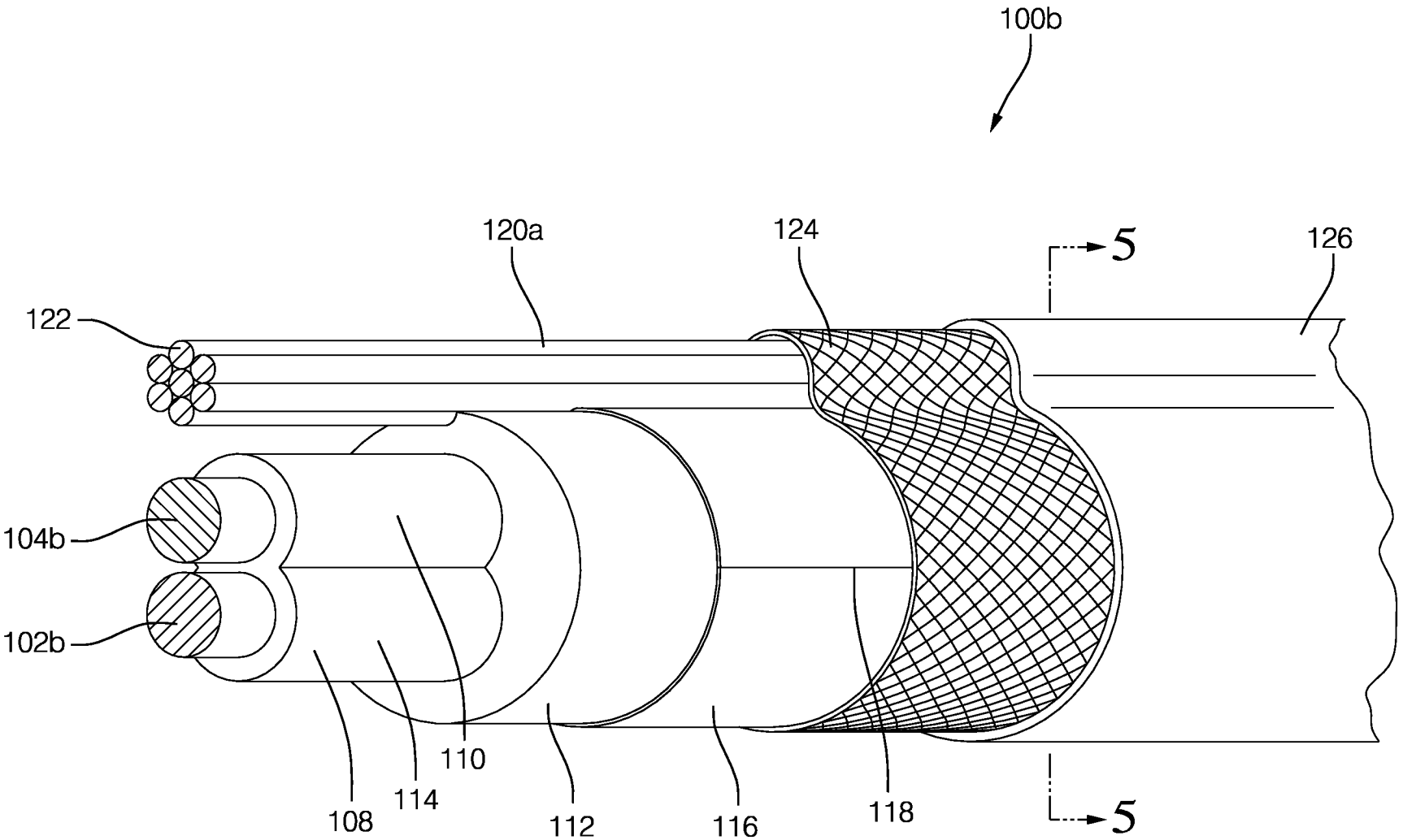
FIG. 4 is perspective cut away drawing of a wire cable of a wire cable assembly having solid conductors in accordance with a third embodiment.
Figure 5:
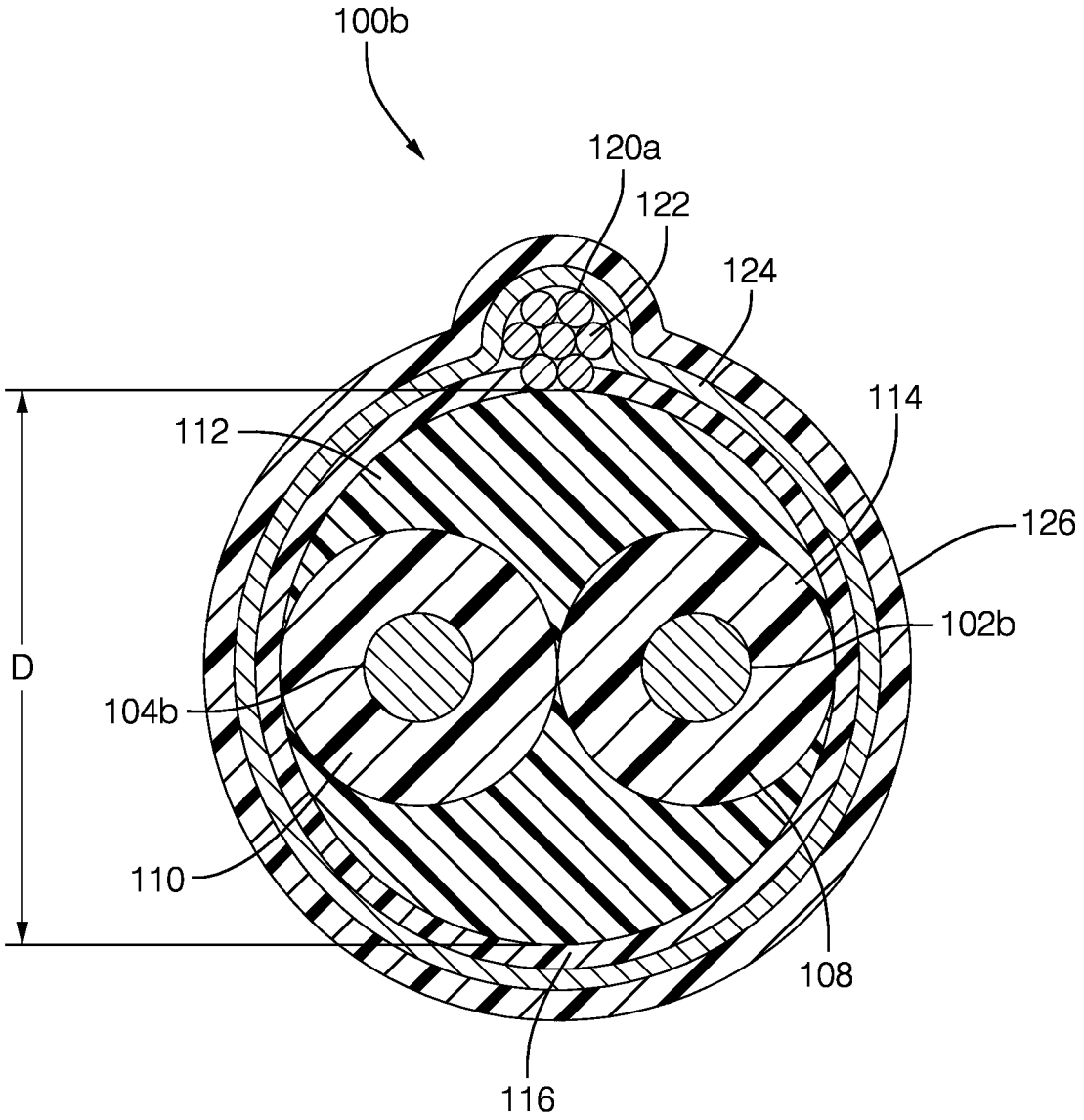
FIG. 5 is a cross section drawing of the wire cable of FIG. 4 in accordance with the third embodiment.

FIGS. 4 and 5 illustrate another non-limiting example of a wire cable 100*b* for transmitting electrical digital data signals. The wire cable 100*b* illustrated in FIGS. 4 and 5 is identical in construction to the wire cable 100*a* shown in FIGS. 1 and 2, with the exception that the first and second conductors 102*b*, 104*b* each comprise a solid wire conductor, such as a bare (non-plated) copper wire or silver plated copper wire having a diameter of about 0.321 millimeters (mm), which is generally equivalent to 28 AWG solid wire. Alternatively, the first and second conductors 102*b*, 104*b* may be formed of a solid wire having a smaller gauge, such as 30 AWG or 32 AWG. The wire cable 100*b* may be characterized as having an impedance of 95 Ohms.

Figure 6:
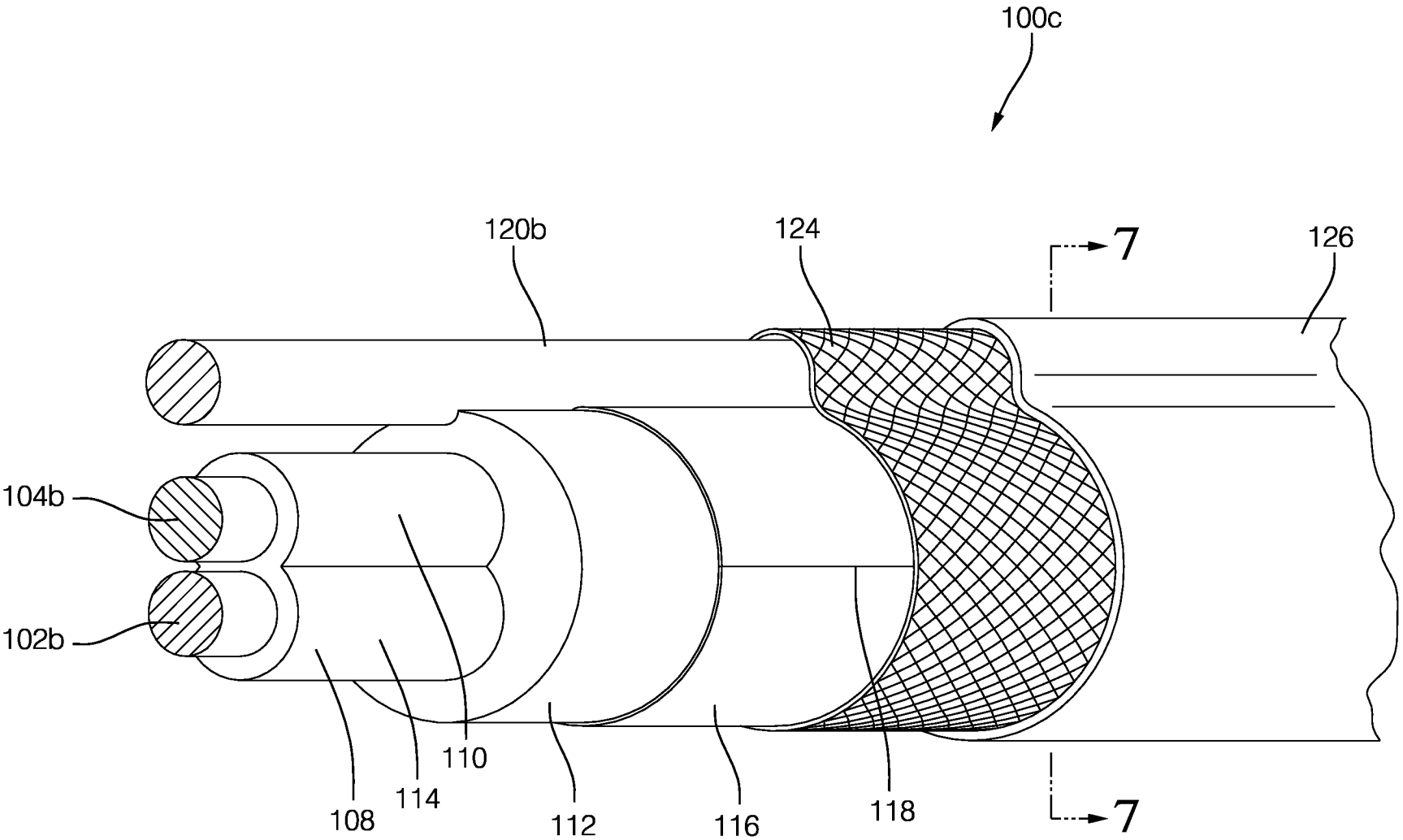
FIG. 6 is a perspective cut away drawing of a wire cable of a wire cable assembly having a solid drain wire in accordance with a fourth embodiment.
Figure 7:
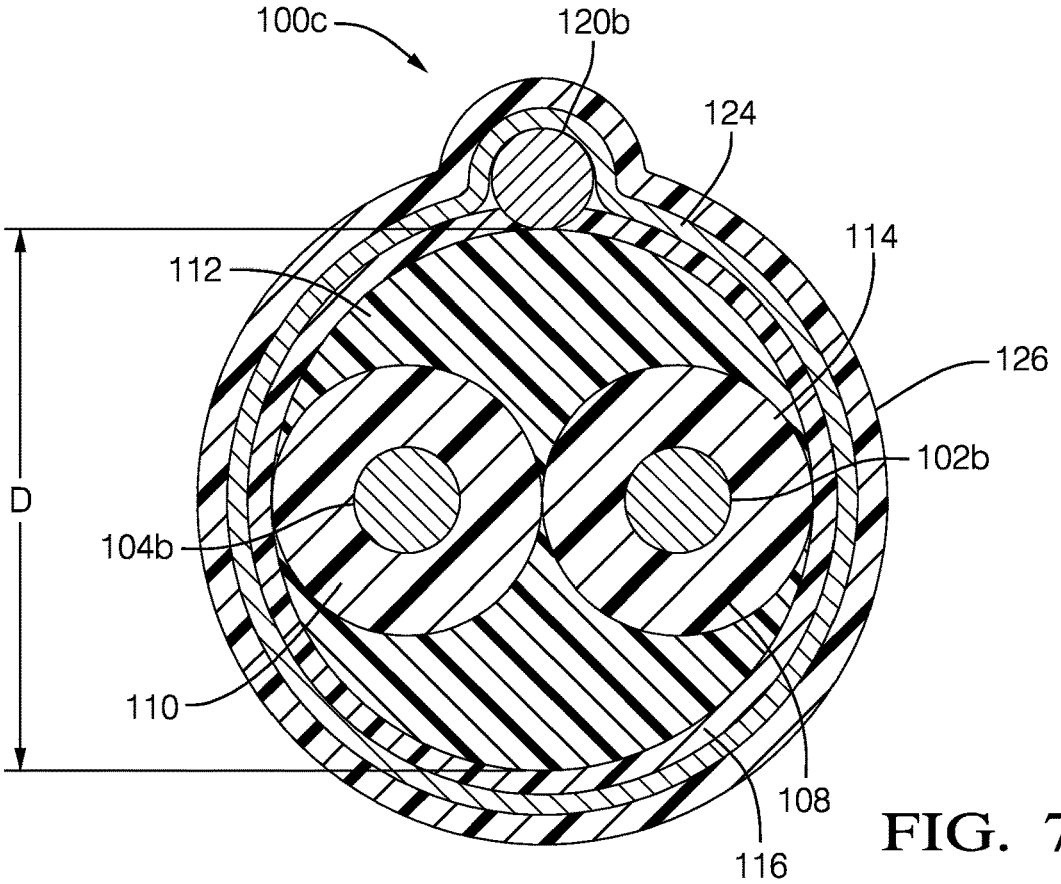
FIG. 7 is a cross section drawing of the wire cable of FIG. 6 in accordance with the fourth embodiment.

FIGS. 6 and 7 illustrate another non-limiting example of a wire cable 100*c* for transmitting electrical digital data signals. The wire cable 100*c* illustrated in FIGS. 6 and 7 is identical in construction to the wire cable 100*b* shown in FIGS. 4 and 5, with the exception that the drain wire 120*b* comprises a solid wire conductor, such as an unplated copper conductor, tin plated copper conductor, or silver plated copper conductor having a cross section of about 0.321 $mm^2$, which is generally equivalent to 28 AWG solid wire. Alternatively, the drain wire 120*b* may be formed of solid wire having a smaller gauge, such as 30 AWG or 32 AWG. The wire cable 100*c* may be characterized as having an impedance of 95 Ohms.

Figure 8:
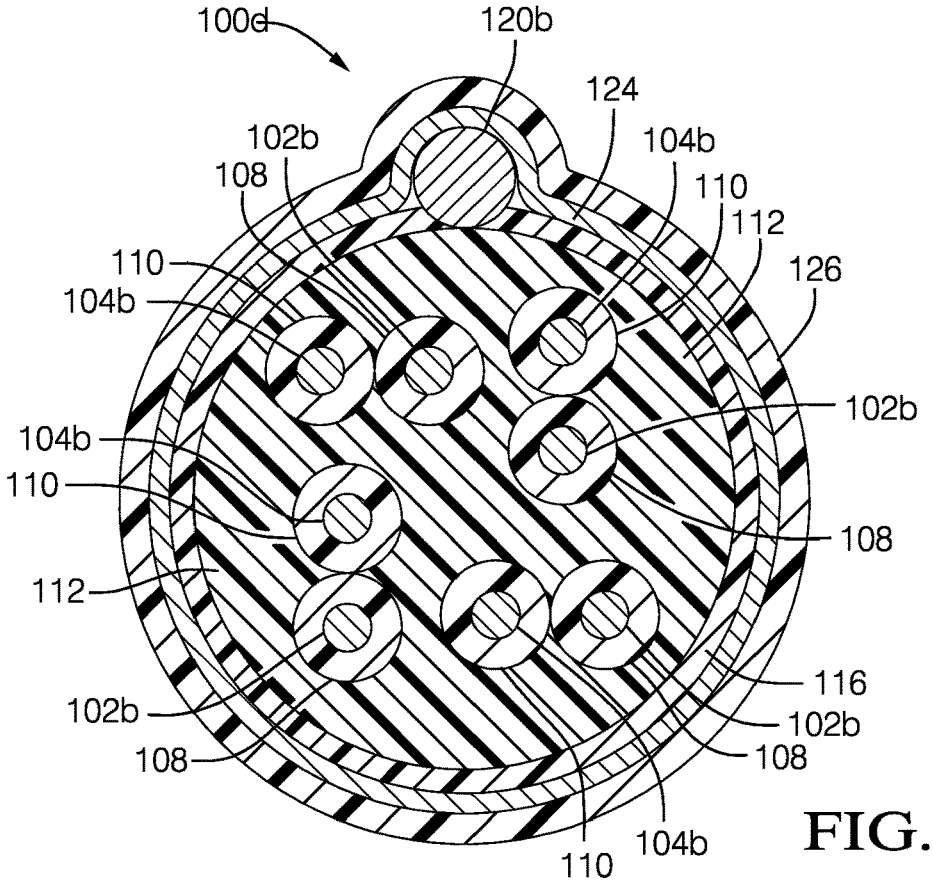
FIG. 8 is a cross section drawing of a wire cable in accordance with a fifth embodiment.

FIG. 8 illustrates yet another non-limiting example of a wire cable 100*d* for transmitting electrical digital data signals. The wire cable 100*d* illustrated in FIG. 5 is similar to the construction to the wire cables 100*a*, 100*b*, 100*c* shown in FIGS. 1-7, however, wire cable 100*d* includes multiple pairs of first and second conductors 102*b*, 104*b*. The belting 112 also eliminates the need for a spacer to maintain separation of the wire pairs as seen in the prior art for wire cables having multiple wire pair conductors. The example illustrated in FIG. 8 includes solid wire conductors 102*b*, 104*b*, and 120*b*. However, alternative embodiments may include stranded wires 102*a*, 104*a*, and 120*a*.

FIG. 9 illustrates the requirements for signal rise time (in picoseconds (ps)) and differential impedance (in Ohms (Q)) for the USB 3.0 and HDMI 1.4 performance specifications. FIG. 9 also illustrates the combined requirements for a wire cable capable of simultaneously meeting both USB 3.0 and HDMI 1.4 standards. The wire cable 100*a*-100*f* is expected to meet the combined USB 3.0 and HDMI 1.4 signal rise time and differential impedance requirements shown in FIG. 9.

FIG. 10 illustrates the differential impedances that are expected for the wire cables 100*a*-100*f* over a signal frequency range of 0 to 7500 MHz (7.5 GHz).

Figure 11:
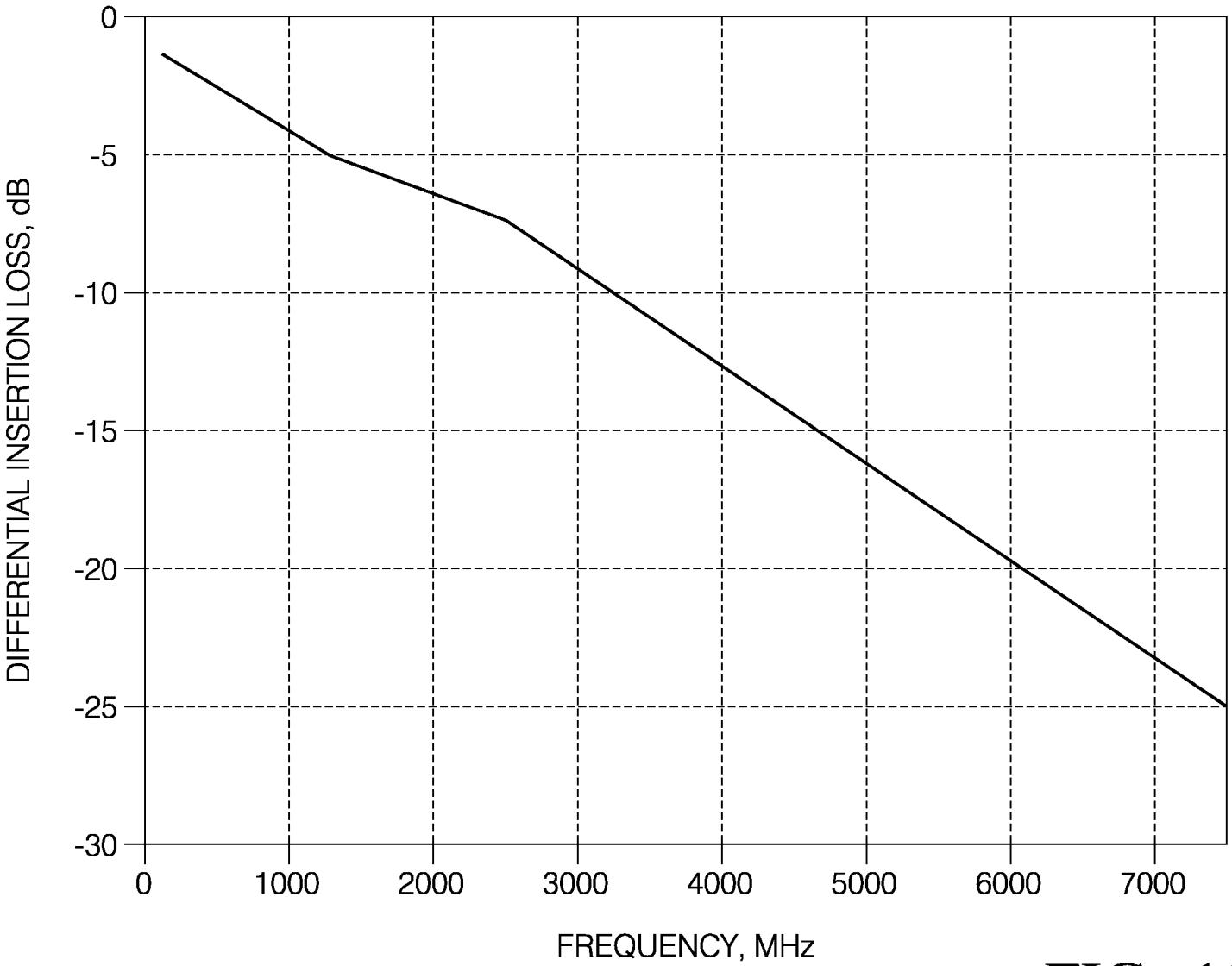
FIG. 11 is a graph of the differential insertion loss versus signal frequency of the wire cable of FIGS. 1-7 in accordance with several embodiments.

FIG. 11 illustrates the insertion losses that are expected for wire cable 100*a*-100*f* with a length of 7 m over the signal frequency range of 0 to 7500 MHz (7.5 GHz).

Therefore, as shown in FIGS. 10 and 11, the wire cable 100*a*-100*f* having a length of up to 7 meters are expected to be capable of transmitting digital data at a speed of up to 5 Gigabits per second with an insertion loss of less than 20 dB.

Figure 12:
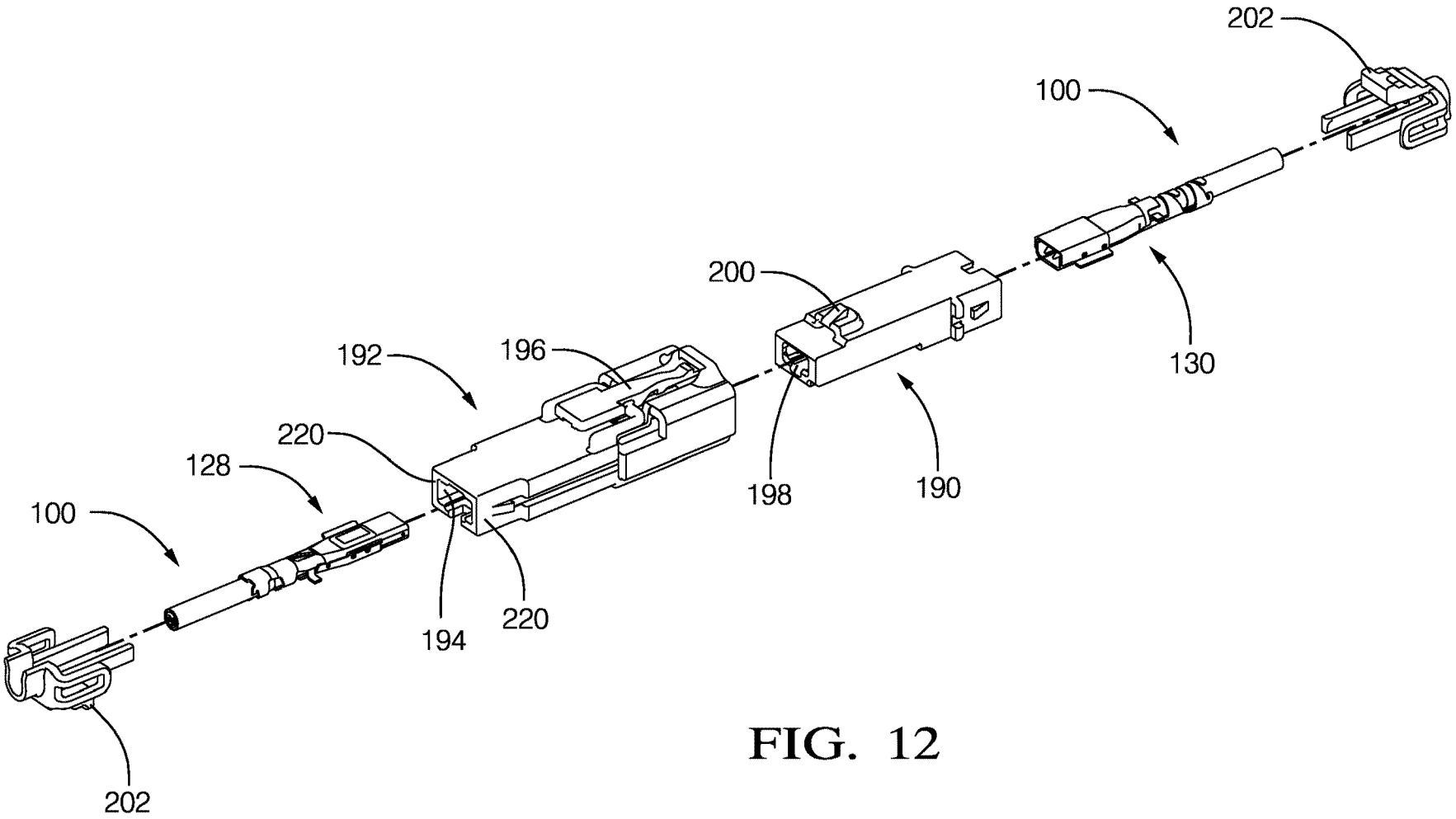
FIG. 12 is an exploded perspective view of a wire cable assembly in accordance with a sixth embodiment.

As illustrated in the non-limiting example of FIG. 12, the wire cable assembly also includes an electrical connector. The connector may be a receptacle connector 128 or a plug connector 130 configured to accept the receptacle connector 128.

Figures 13, 14:
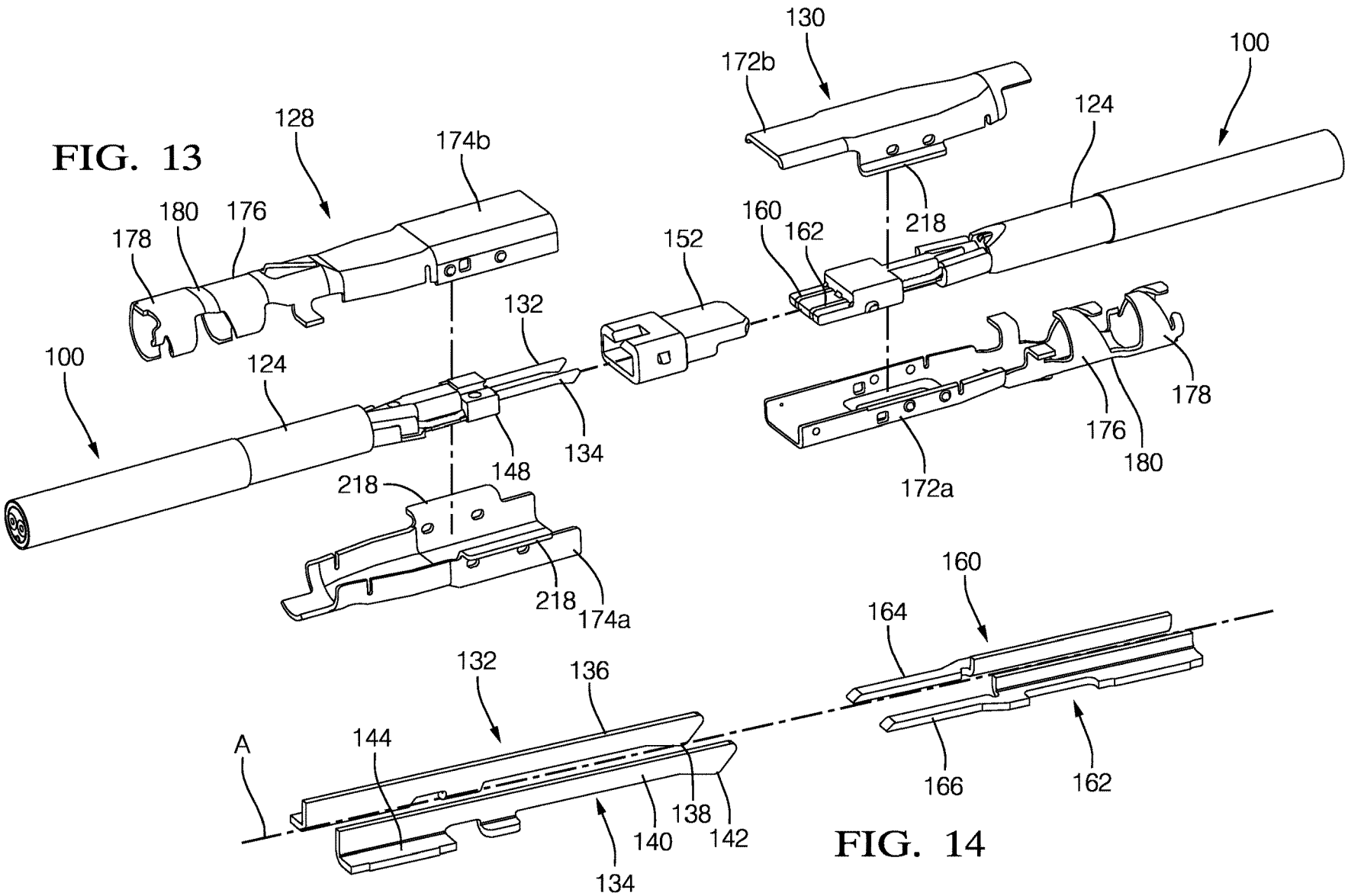
FIG. 13 is an exploded perspective view of a subset of the components of the wire cable assembly of FIG. 12 in accordance with the sixth embodiment.
FIG. 14 is a perspective view of the receptacle and plug terminals of the wire cable assembly of FIG. 12 in accordance with the sixth embodiment.

As illustrated in FIG. 13, the receptacle connector 128 include two terminals, a first receptacle terminal 132 connected to a first inner conductor 102 and a second receptacle terminal 134 connected to a second inner conductor (not shown due to drawing perspective) of the wire cable 100. As shown in FIG. 14, the first receptacle terminal 132 includes a first cantilever beam portion 136 that has a generally rectangular cross section and defines a convex first contact point 138 that depends from the first cantilever beam portion 136 near the free end of the first cantilever beam portion 136. The second receptacle terminal 134 also includes a similar second cantilever beam portion 140 having a generally rectangular cross section and defining a convex second contact point 142 depending from the second cantilever beam portion 140 near the free end of the second cantilever beam portion 140. The first and second receptacle terminals 132, 134 each comprise an attachment portion 144 that is configured to receive the end of an inner conductor of the wire cable 100 and provide a surface for attaching the first and second inner conductors 102, 104 to the first and second receptacle terminals 132, 134. As shown in FIG. 14, the attachment portion 144 defines an L shape. The first and second receptacle terminals 132, 134 form a mirrored terminal pair that has bilateral symmetry about the longitudinal axis A and are substantially parallel to the longitudinal axis A and each other. In the illustrated embodiment, the distance between the first cantilever beam portion 136 and the second cantilever beam portion 140 is 2.85 mm, center to center.

Figure 15:
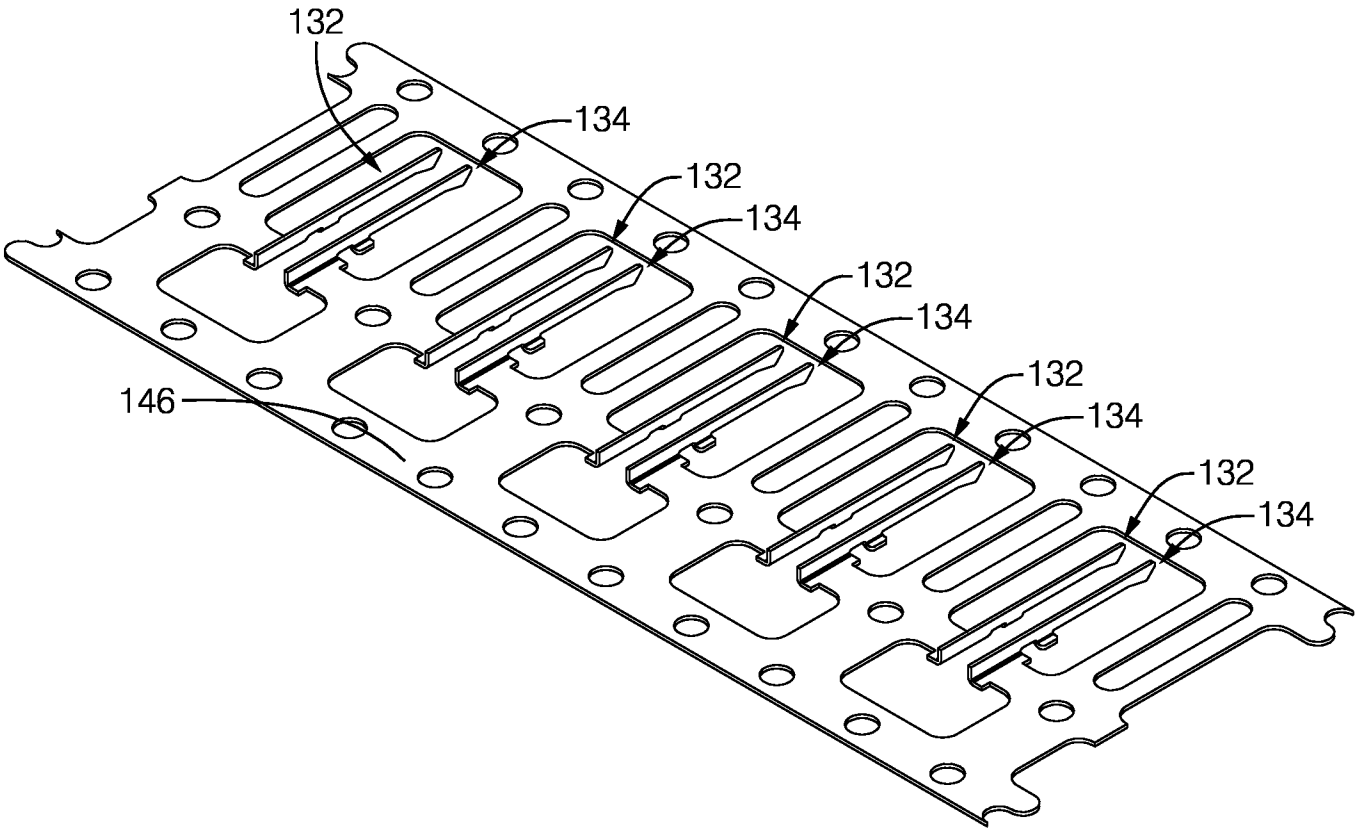
FIG. 15 is a perspective view of the receptacle terminals of the wire cable assembly of FIG. 12 contained in a carrier strip in accordance with the sixth embodiment.

As illustrated in FIG. 15, the first and second receptacle terminals 132, 134 are formed from a sheet of conductive material by a stamping process that cuts out and bends the sheet to form the first and second receptacle terminals 132, 134. The stamping process also forms a carrier strip 146 to which the first and second receptacle terminals 132, 134 are attached. The first and second receptacle terminals 132, 134 are formed using a fine blanking process that provides a shear cut of at least 80% or greater through the stock thickness. This provides a smoother surface on the minor edges of the cantilever beam portions and the contact point that reduces connection abrasion between the receptacle connector 128 and the plug connector 130. The attachment portion 144 is then bent to the L shape in a subsequent forming operation.

Figure 16:
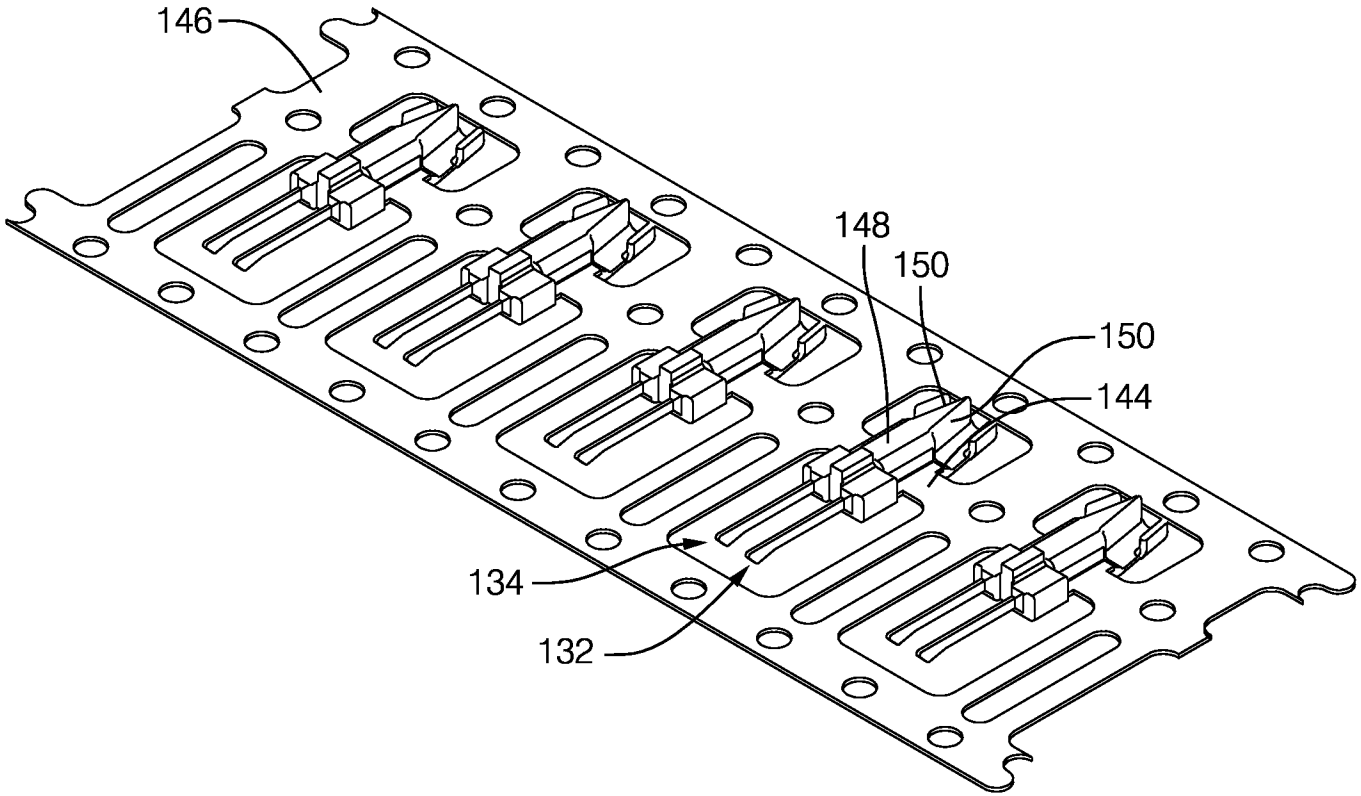
FIG. 16 is a perspective view of the receptacle terminals assembly of FIG. 15 encased within a receptacle terminal holder in accordance with the sixth embodiment.

As illustrated in FIG. 16, first and second receptacle terminals 132, 134 remain attached to the carrier strip 146 for an insert molding process that forms a receptacle terminal holder 148 that partially encases the first and second receptacle terminal 132, 134. The receptacle terminal holder 148 maintains the spatial relationship between the first and second receptacle terminals 132, 134 after they are separated from the carrier strip 146. The receptacle terminal holder 148 also defines a pair of wire guide channels 150 that help to maintain a consistent separation between the first and second inner conductors 102, 104 as they transition from the wire cable 100 to the attachment portions 144 of the first and second receptacle terminals 132, 134. The receptacle terminal holder 148 is formed of a dielectric material, such as a liquid crystal polymer. This material offers performance advantages over other engineering plastics, such as polyamide or polybutylene terephthalate, for molding, processing, and electrical dielectric characteristics.

Figure 17:
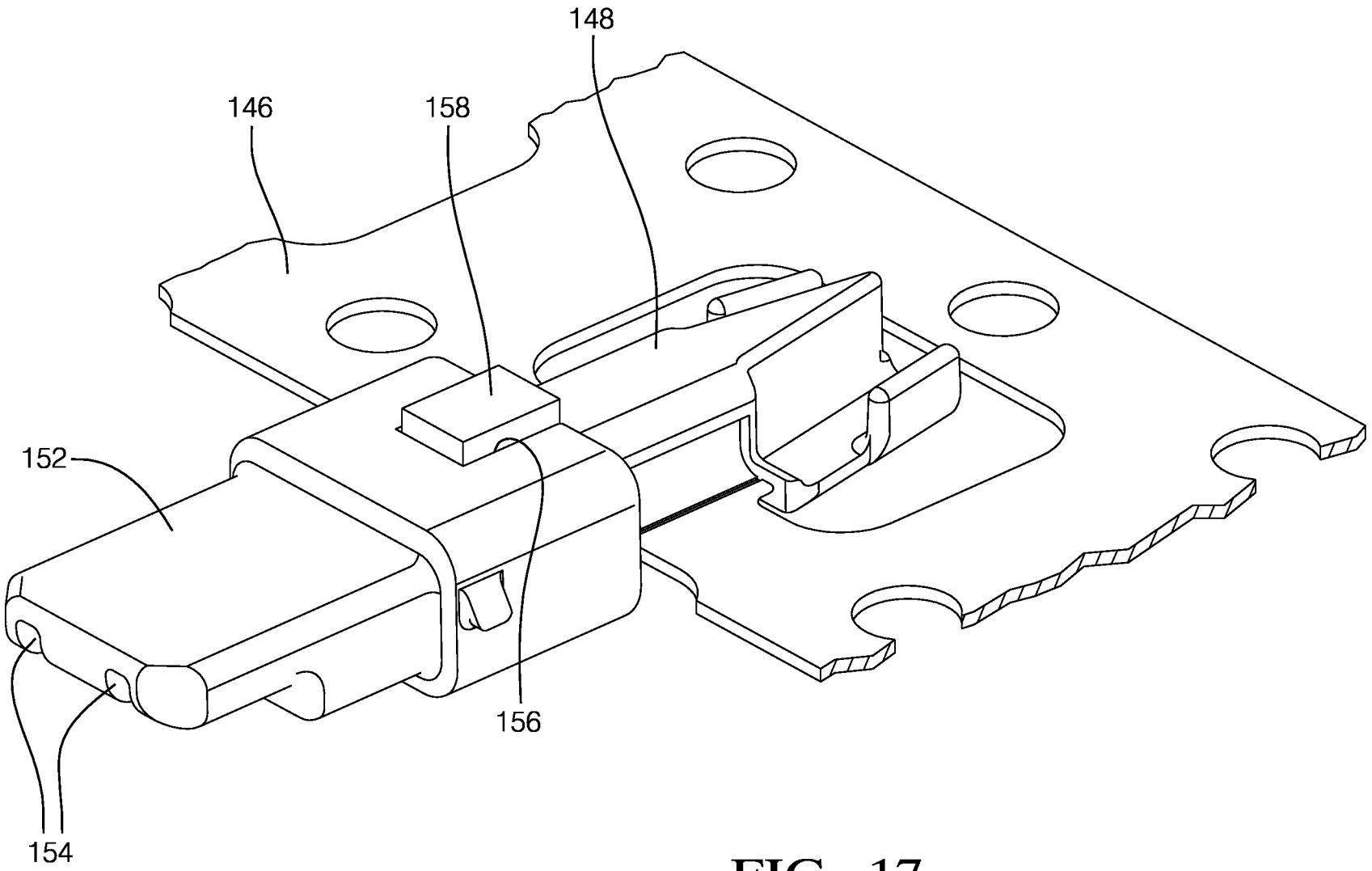
FIG. 17 is a perspective view of the receptacle terminals assembly of FIG. 16 including a receptacle terminal cover in accordance with the sixth embodiment.

As illustrated in FIG. 17, a portion of the carrier strip 146 is removed and a receptacle terminal cover 152 is then attached to the receptacle terminal holder 148. The receptacle terminal cover 152 is configured to protect the first and second receptacle terminals 132, 134 from bending while the receptacle connector 128 is being handled and when the plug connector 130 is being connected or disconnected with the receptacle connector 128. The receptacle terminal cover 152 defines a pair of grooves 154 that allow the first and second cantilever beam portions 136, 140 to flex when the plug connector 130 is connected to the receptacle connector 128. The receptacle terminal cover 152 may also be formed of same liquid crystal polymer material as the receptacle terminal holder 148, although other dielectric materials may alternatively be used. The receptacle terminal holder 148 defines an elongate slot 156 that mated to an elongate post 158 defined by the receptacle terminal holder 148. The receptacle terminal cover 152 is joined to the receptacle terminal holder 148 by ultrasonically welding the post 158 within the slot 156. Alternatively, other means of joining the receptacle terminal holder 148 to the receptacle terminal cover 152 may be employed.

The remainder of the carrier strip 146 is removed from the first and second receptacle terminals 132, 134 prior to attaching the first and second inner conductors 102, 104 to the first and second receptacle terminals 132, 134.

Figure 18:
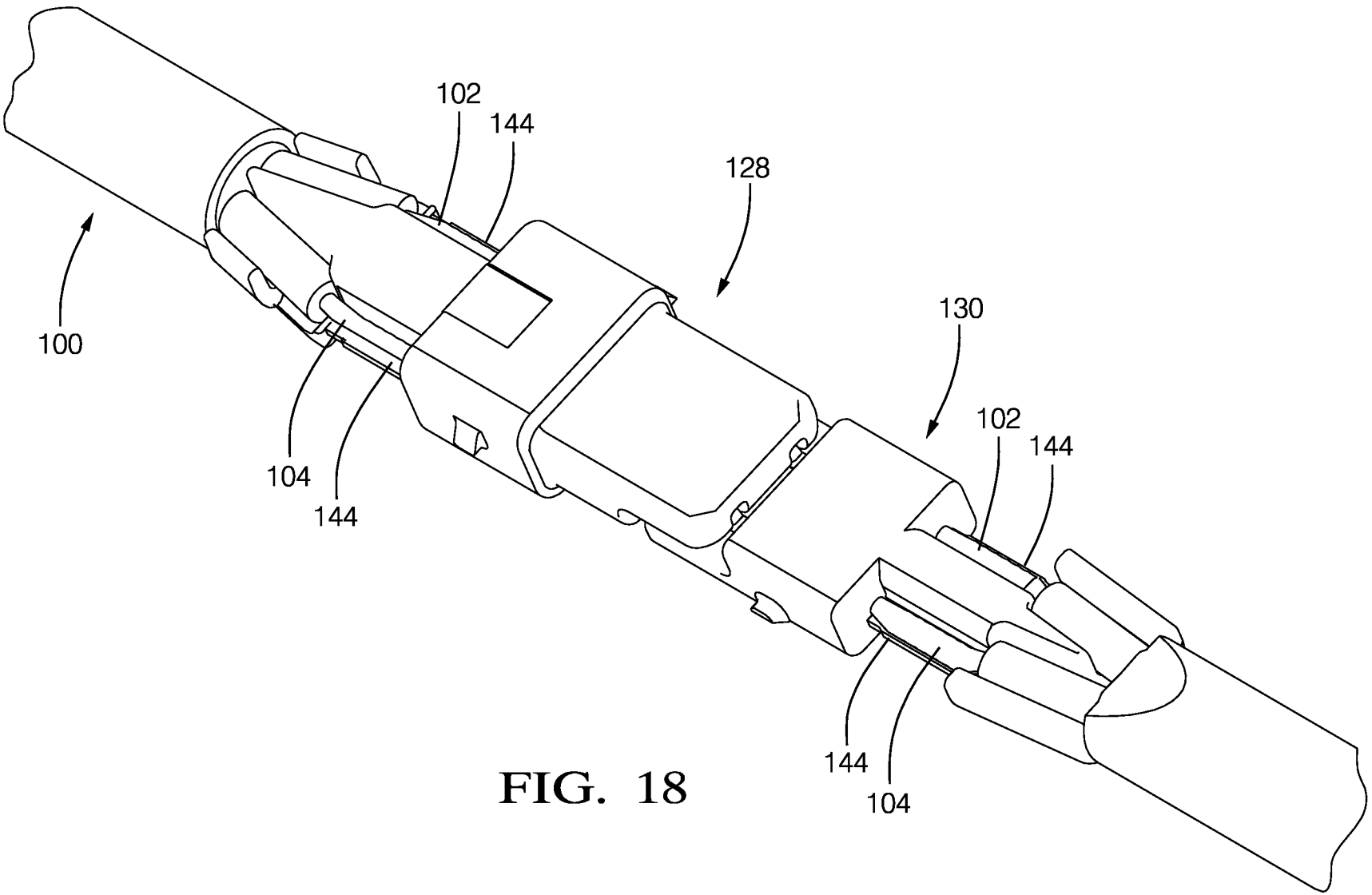
FIG. 18 is a perspective assembly view of the wire cable assembly of FIG. 13 in accordance with the sixth embodiment.

As illustrated in FIG. 18, the first and second inner conductors 102, 104 are attached to the attachment portions 144 of the first and second receptacle terminals 132, 134 using an ultrasonic welding process. Sonically welding the conductors to the terminals allows better control of the mass of the joint between the conductor and the terminal than other joining processes such as soldering and therefore provides better control over the capacitance associated with the joint between the conductor and the terminal. It also avoids environmental issues caused by using solder.

Returning again to FIG. 13, the plug connector 130 also includes two terminals, a first plug terminal 160 connected to a first inner conductor 102 and a second plug terminal 162 connected to a second inner conductor (not shown) of the wire cable 100. As shown in FIG. 14, the first plug terminal 160 includes a first elongate planar portion 164 that has a generally rectangular cross section. The second plug terminal 162 also includes a similar second elongate planar portion 166. The planar portions of the plug terminals are configured to receive and contact the first and second contact points 138, 142 of the first and second receptacle terminals 132, 134. The free ends of the planar portions have a beveled shape to allow the mating first and second receptacle terminals 132, 134 to ride up and over free ends of the first and second planar portions 164, 166 when the plug connector 130 and receptacle connector 128 are mated. The first and second plug terminals 160, 162 each comprise an attachment portion 144 similar to the attachment portions 144 of the first and second receptacle terminals 132, 134 that are configured to receive the ends of the first and second inner conductors 102, 104 and provide a surface for attaching the first and second inner conductors 102, 104 to the first and second plug terminals 160, 162. As shown in FIG. 14, the attachment portion 144 defines an L shape. The first and second plug terminals 160, 162 form a mirrored terminal pair that has bilateral symmetry about the longitudinal axis A and are substantially parallel to the longitudinal axis A and each other. In the illustrated embodiment, the distance between the first planar portion and the second planar portion is 2.85 mm, center to center. The inventors have observed through data obtained from computer simulation that the mirrored parallel receptacle terminals and plug terminals have a strong effect on the high speed electrical properties, such as impedance and insertion loss, of the wire cable assembly.

Figure 19:
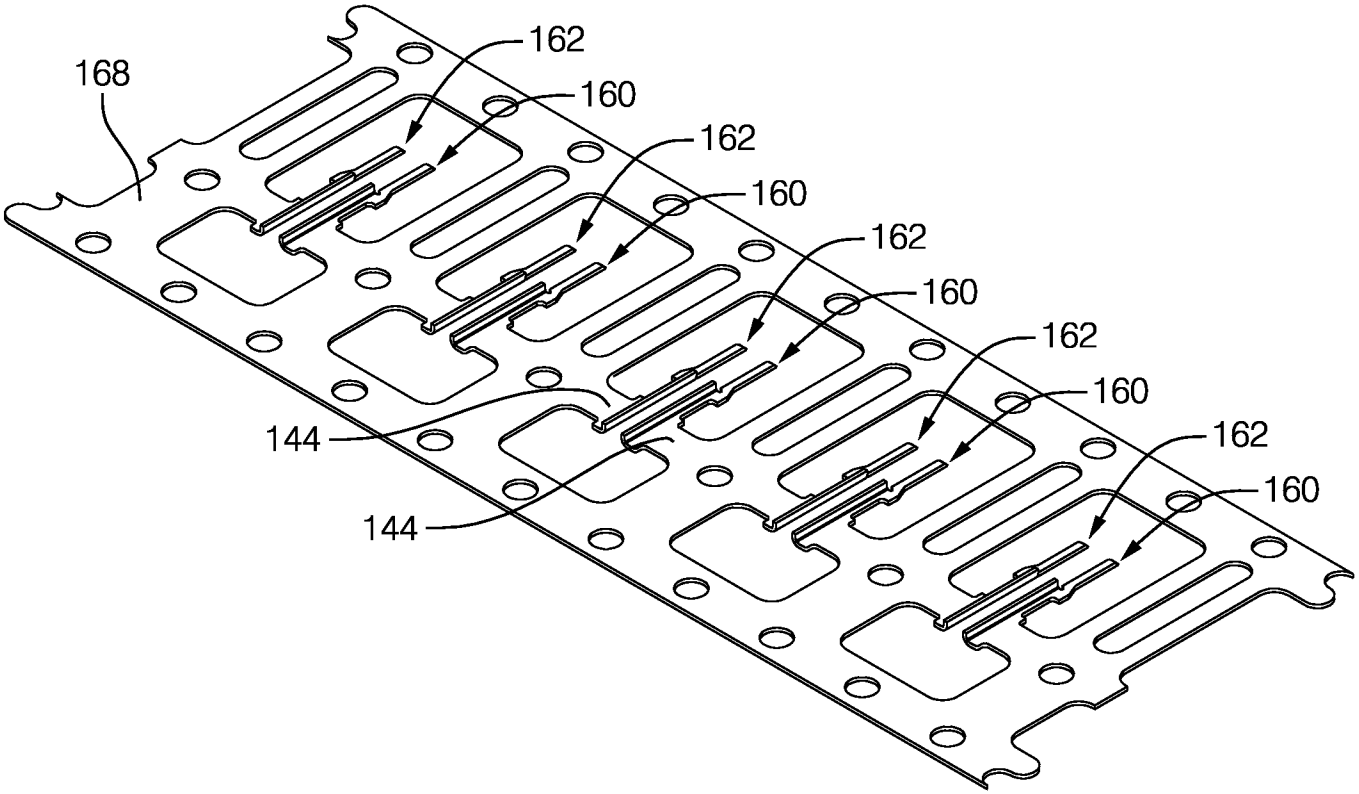
FIG. 19 is a perspective view of the plug terminals of the wire cable assembly of FIG. 12 contained in a carrier strip in accordance with the sixth embodiment.

As illustrated in FIG. 19, the plug terminals are formed from a sheet of conductive material by a stamping process that cuts out and bends the sheet to form the plug terminals. The stamping process also forms a carrier strip 168 to which the plug terminals are attached. The attachment portion 144 is then bent to the L shape in a subsequent forming operation.

Figure 20:
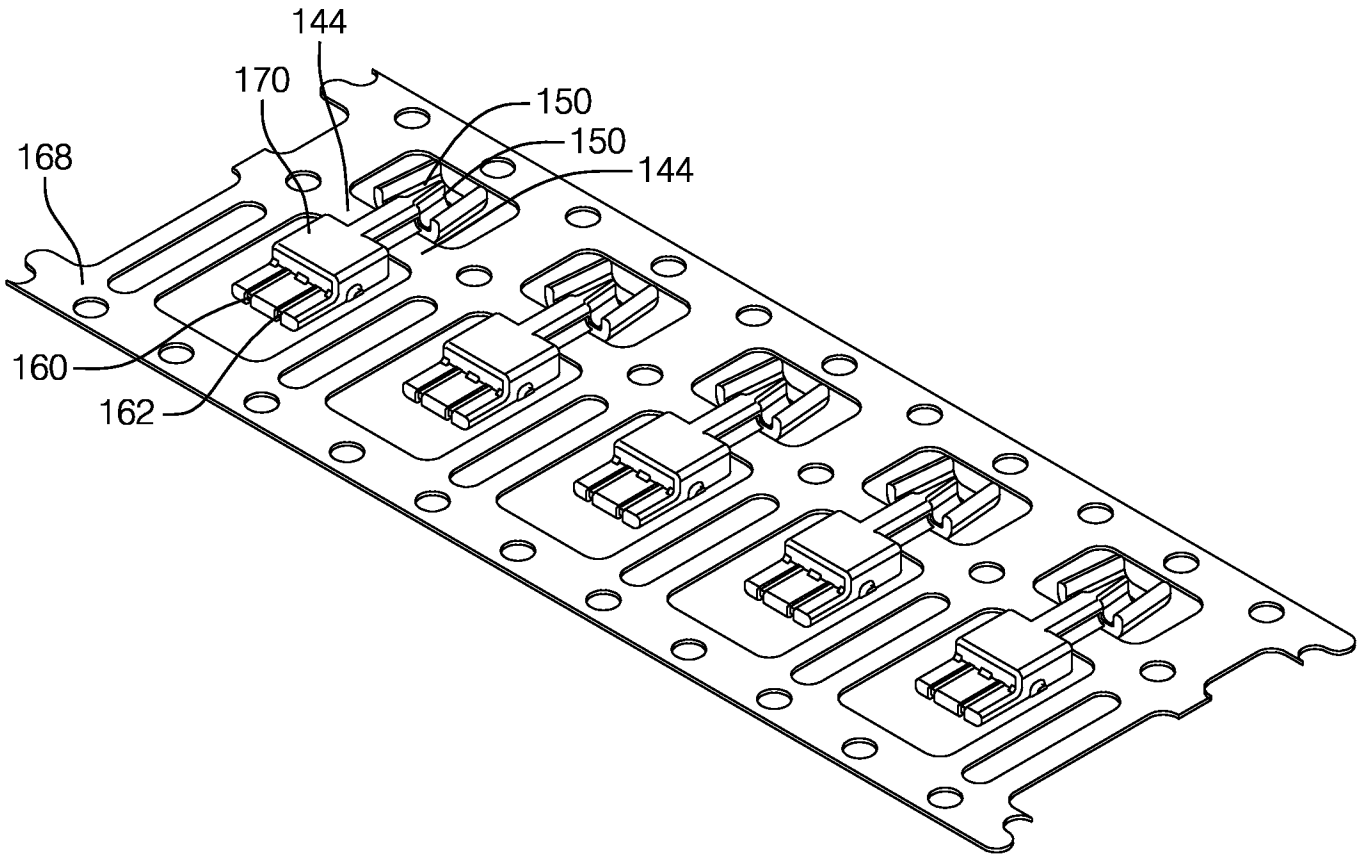
FIG. 20 is a perspective view of the plug terminals assembly of FIG. 19 encased within a plug terminal holder in accordance with the sixth embodiment.

As illustrated in FIG. 20, the plug terminals remain attached to the carrier strip 168 for an insert molding process that forms a plug terminal holder 170 that partially encases the first and second plug terminals 160, 162. The plug terminal holder 170 maintains the spatial relationship between the first and second plug terminals 160, 162 after they are separated from the carrier strip 168. The plug terminal holder 170, similarly to the receptacle terminal holder 148, defines a pair of wire guide channels 150 that help to maintain a consistent separation between the first and second inner conductors 102, 104 as they transition from the wire cable 100 to the attachment portions 144 of the first and second receptacle terminals 132, 134. The plug terminal holder 170 is formed of a dielectric material, such as a liquid crystal polymer.

The carrier strip 168 is removed from the plug terminals prior to attaching the first and second inner conductors 102, 104 to first and second plug terminals 160, 162.

As illustrated in FIG. 18, the first and second inner conductors 102, 104 of the wire cable 100 are attached to the attachment portions 144 of the first and second plug terminals 160, 162 using an ultrasonic welding process.

As illustrated in FIGS. 13 and 14, the first and second plug terminals 160, 162 and the first and second receptacle terminals 132, 134 are oriented in the plug and receptacle connectors 128, 130 so that when the plug and receptacle connectors 128, 130 are mated, the major widths of the first and second receptacle terminals 132, 134 are substantially perpendicular to the major widths of the first and second plug terminals 160, 162. As used herein, substantially perpendicular means that the major widths are ±15° of absolutely perpendicular. The inventors have observed that this orientation between the first and second plug terminals 160, 162 and the first and second receptacle terminals 132, 134 has strong effect on insertion loss. Also, when the plug and receptacle connectors 128, 130 are mated, the first and second receptacle terminals 132, 134 overlap the first and second plug terminals 160, 162. The plug and receptacle connectors 128, 130 are configured so that only the first and second contact points 138, 142 of the first and second receptacle terminals 132, 134 contacts the planar blade portion of the first and second plug terminals 160, 162 and the contact area defined between the first and second receptacle terminals 132, 134 and the first and second plug terminals 160, 162 is less than the area overlapped between the first and second receptacle terminals 132, 134 and the first and second plug terminals 160, 162. Therefore, the contact area, sometimes referred to as the wipe distance, is determined by the area of the first and second contact points 138, 142 and not by the overlap between the terminals. Therefore, the receptacle and plug terminals provide the benefit of a consistent contact area as long as the first and second contact points 138, 142 of the first and second receptacle terminals 132, 134 are fully engaged with the first and second plug terminals 160, 162. Because both the plug and receptacle terminals are a mirrored pair, a first contact area between the first receptacle terminal 132 and the first plug terminal 160 and a second contact area between the second receptacle terminal 134 and the second plug terminal 162 are substantially equal. As used herein, substantially equal means that the contact area difference between the first contact area and the second contact area is less than 0.1 $mm^2$. The inventors have observed through data obtained from computer simulation that the contact area between the plug and receptacle terminals and the difference between the first contact are a and the second contact area have a strong impact on insertion loss of the wire cable assembly.

The first and second plug terminals 160, 162 are not received within the first and second receptacle terminals 132, 134, therefore the first contact area is on the exterior of the first plug terminal 160 and the second contact area is on the exterior of the second plug terminal 162 when the plug connector 130 is mated to the receptacle connector 128.

The first and second receptacle terminals 132, 134 and the first and second plug terminals 160, 162 may be formed from a sheet of copper-based material. The first and second cantilever beam portions 136, 140 and the first and second planar portions 164, 166 may be selectively plated using copper/nickel/silver based plating. The terminals may be plated to a 5 skin thickness. The first and second receptacle terminals 132, 134 and the first and second plug terminals 160, 162 are configured so that the receptacle connector 128 and plug connector 130 exhibit a low insertion normal force of about 0.4 Newton (45 grams). The low normal force provides the benefit of reducing abrasion of the plating during connection/disconnection cycles.

As illustrated in FIG. 13, the plug connector 130 includes a plug shield 172 that is attached to the outer shield 124 of the wire cable 100. The plug shield 172 is separated from and longitudinally surrounds the first and second plug terminals 160, 162 and plug terminal holder 170. The receptacle connector 128 also includes a receptacle shield 174 that is attached to the outer shield 124 of the wire cable 100 that is separated from and longitudinally surrounds the first and second receptacle terminals 132, 134, receptacle terminal holder 148 and receptacle terminal cover 152. The receptacle shield 174 and the plug shield 172 are configured to slidingly contact one another and when mated, provide electrical continuity between the outer shields of the attached wire cables 100 and electromagnetic shielding to the plug and receptacle connectors 128, 130.

Figure 21:
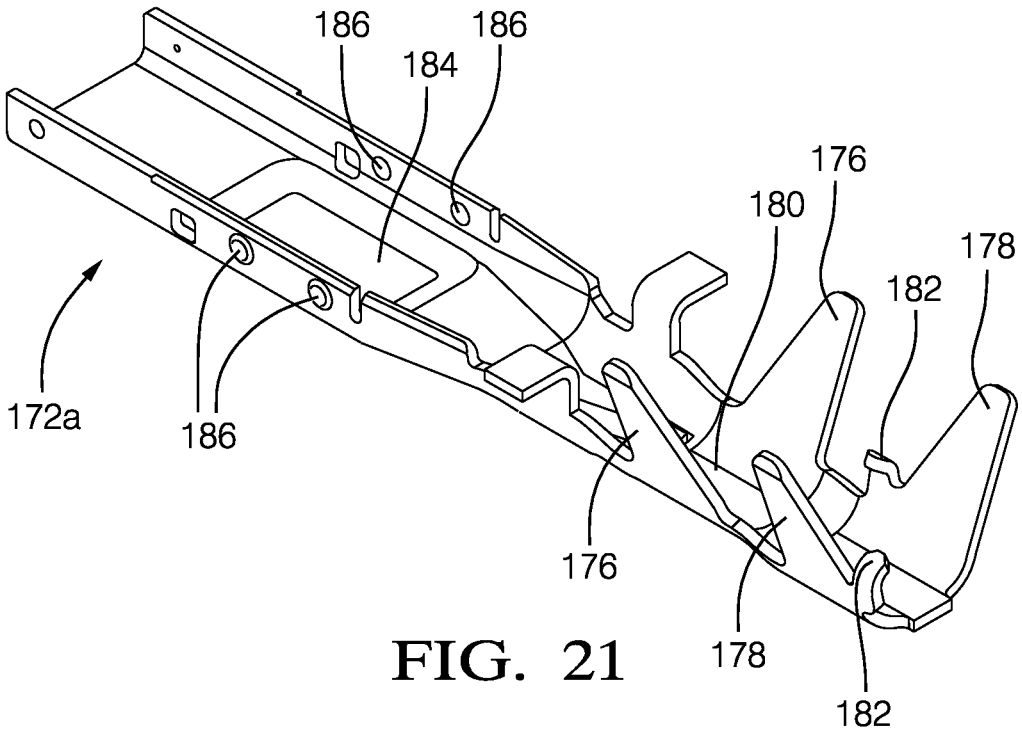
FIG. 21 is perspective view of a plug connector shield half of the wire cable assembly of FIG. 13 in accordance with the sixth embodiment.
Figure 22:
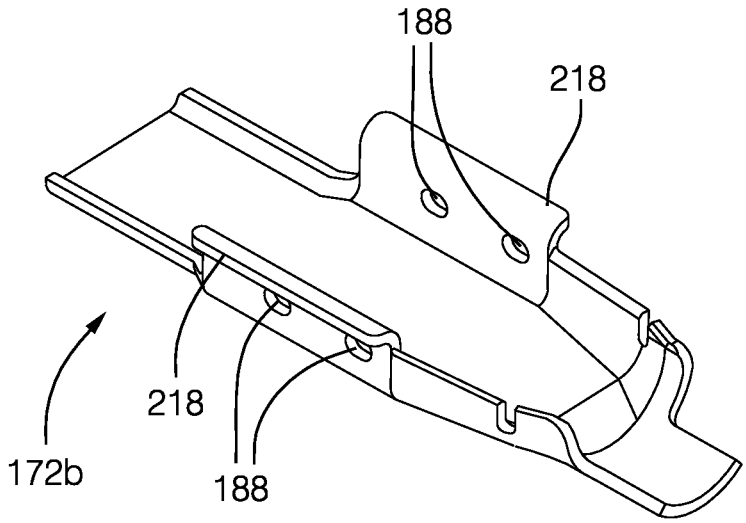
FIG. 22 is perspective view of another plug connector shield half of the wire cable assembly of FIG. 13 in accordance with the sixth embodiment.

As shown in FIGS. 13, 21 and 22, the plug shield 172 is made of two parts. The first plug shield 172A illustrated in FIG. 21 includes two pairs of crimping wings, conductor crimp wings 176 and insulator crimp wings 178, adjacent an attachment portion 180 configured to receive the wire cable 100. The conductor crimp wings 176 are bypass-type crimp wings that are offset and configured to surround the exposed outer shield 124 of the wire cable 100 when the conductor crimp wings 176 are crimped to the wire cable 110. The drain wire 120*a* is electrically coupled to the first plug shield 172A when the first plug shield 172A is crimped to the outer shield 124 because the drain wire 120*a* of the wire cable 100 is sandwiched between the outer shield 124 and the inner shield 116 of the wire cable 110. This provides the benefit of coupling the plug shield 172 to the drain wire 120 without having to orient the drain wire 120 in relation to the shield before crimping.

The attachment portion 180 and the interior of the conductor crimp wings 176 may define a plurality of rhomboid indentations configured to improve electrical connectivity between the first plug shield 172A and the outer shield 124 of the wire cable 100. Such rhomboid indentations are described in U.S. Pat. No. 8,485,853, the entire disclosure of which is hereby incorporated by reference.

The insulation crimp wings are also bypass type wings that are offset and configured to surround the jacket 126 of the wire cable 100 when the plug shield 172 is crimped to the wire cable 110. The each of the insulation crimp wings further include a prong 182 having a pointed end that is configured to penetrate at least the outer insulator of the wire cable 100. The prongs 182 inhibit the plug shield 172 from being separated from the wire cable 100 when a force is applied between the plug shield 172 and the wire cable 100. The prongs 182 also inhibit the plug shield 172 from rotating about the longitudinal axis A of the wire cable 100. The prongs 182 may also penetrate the outer shield 124, inner shield 116, or belting 112 of the wire cable 100 but should not penetrate the first and second insulators 108, 110. While the illustrated example includes two prongs 182, alternative embodiments of the invention may be envisioned using only a single prong 182 define by the first plug shield 172A.

The first plug shield 172A defines an embossed portion 184 that is proximate to the connection between the attachment portions 144 of the plug terminals and the first and second inner conductors 102, 104. The embossed portion 184 increases the distance between the attachment portions 144 and the first plug shield 172A, thus decreasing the capacitive coupling between them.

The first plug shield 172A further defines a plurality of protrusions 218 or bumps 186 that are configured to interface with a corresponding plurality of holes 188 defined in the second plug shield 172B as shown in FIG. 22. The bumps 186 are configured to snap into the holes 188, thus mechanically securing and electrically connecting the second plug shield 172B to the first plug shield 172A.

Figure 23:
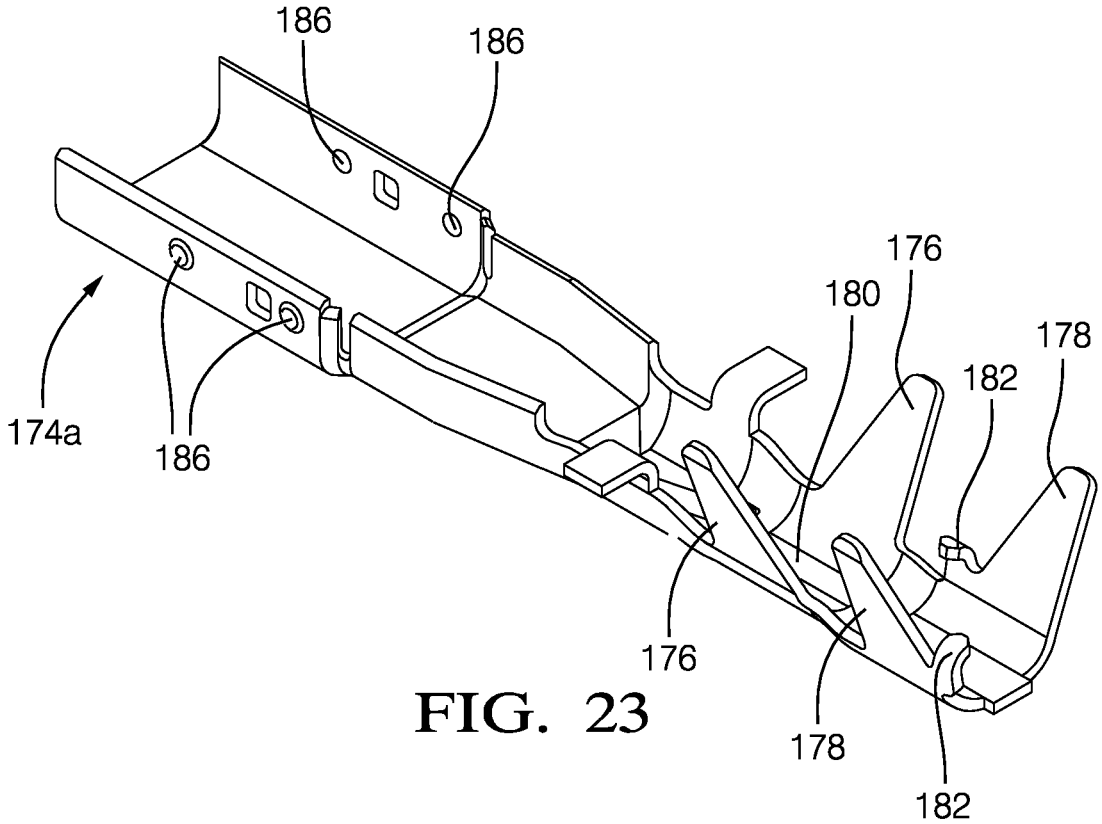
FIG. 23 is perspective view of a receptacle connector shield half of the wire cable assembly of FIG. 13 in accordance with the sixth embodiment.
Figure 24:
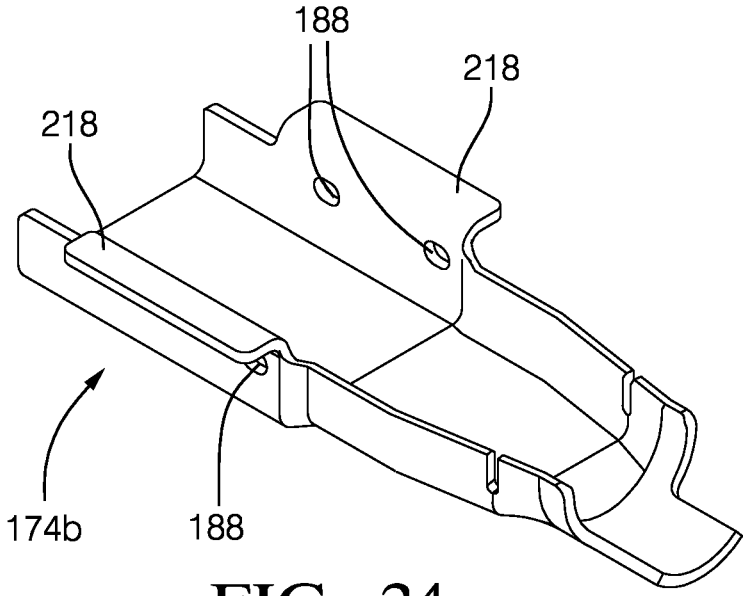
FIG. 24 is perspective view of another receptacle connector shield half of the wire cable assembly of FIG. 13 in accordance with the sixth embodiment.

As shown in FIGS. 13, 23 and 24, the receptacle shield 174 is similarly made of two parts. The first receptacle shield 174A, illustrated in FIG. 23, includes two pairs of crimping wings, conductor crimp wings 176 and insulator crimp wings 178, adjacent an attachment portion 180 configured to receive the wire cable 110. The conductor crimp wings 176 are bypass-type crimp wings that are offset and configured to surround the exposed outer shield 124 of the wire cable 100 when the conductor crimp wings 176 are crimped to the wire cable 100. The attachment portion 144 and the interior of the conductor crimp wings 176 may define a plurality of rhomboid indentations configured to improve electrical connectivity between the first plug shield 172A and the outer shield 124 of the wire cable 100.

The insulation crimp wings are also bypass type wings that are offset and configured to surround the jacket 126 of the wire cable 100 when the plug shield 172 is crimped to the wire cable 100. The insulation crimp wings further include a prong 182 having a pointed end that is configured to penetrate at least the outer insulator of the wire cable 100. The prongs 182 may also penetrate the outer shield 124, inner shield 116, or belting of the wire cable 100. While the illustrated example includes two prongs 182, alternative embodiments of the invention may be envisioned using only a single prong 182.

The first receptacle shield 174A defines a plurality of protrusions 218 or bumps 186 that are configured to interface with a corresponding plurality of holes 188 defined in the second receptacle shield 174B securing the second receptacle shield 174 to the first receptacle shield 174A. The first receptacle shield 174A may not define an embossed portion proximate the connection between the attachment portions 144 of the first and second receptacle terminals 132, 134 and the first and second inner conductors 102, 104 because the distance between the connection and the receptacle shield 174 is larger to accommodate insertion of the plug shield 172 within the receptacle shield 174.

While the exterior of the plug shield 172 of the illustrated example is configured to slideably engage the interior of the receptacle shield 174, alternative embodiments may be envisioned wherein the exterior of the receptacle shield 174 slideably engages the interior of the plug shield 172.

The receptacle shield 174 and the plug shield 172 may be formed from a sheet of copper-based material. The receptacle shield 174 and the plug shield 172 may be plated using copper/nickel/silver or tin based plating. The first and second receptacle shield 174A, 174B and the first and second plug shield 172A, 172B may be formed by stamping processes well known to those skilled in the art.

While the examples of the plug connector and receptacle connector illustrated herein are connected to a wire cable, other embodiments of the plug connector and receptacle connector may be envisioned that are connected to conductive traces on a circuit board.

To meet the requirements of application in an automotive environment, such as vibration and disconnect resistance, the wire cable assembly 100 may further include a receptacle connector body 190 and a plug connector body 192 as illustrated in FIG. 12. The receptacle connector body 190 and the plug connector body 192 are formed of a dielectric material, such as a polyester material.

Returning again to FIG. 12, the plug connector body 192 defines a cavity 194 that receives the plug connector shield assembly 128. The plug connector body 192 also defines a shroud configured to accept the receptacle connector body 190. The plug connector body 192 further defines a low profile latching mechanism with a locking arm 196 configured to secure the plug connector body 192 to the receptacle connector body 190 when the receptacle and plug connector bodies 190, 192 are fully mated. The receptacle connector body 190 similarly defines a cavity 198 that receives the receptacle connector shield assembly 130. The receptacle connector body 190 defines a lock tab 200 that is engaged by the locking arm 196 to secure the plug connector body 192 to the receptacle connector body 190 when the receptacle and plug connector bodies 190, 192 are fully mated. The wire cable assembly 100 also includes connector position assurance devices 202 that hold the plug connector shield assembly 128 and the receptacle connector shield assembly 130 within their respective connector body cavities 194, 198.

Figure 25:
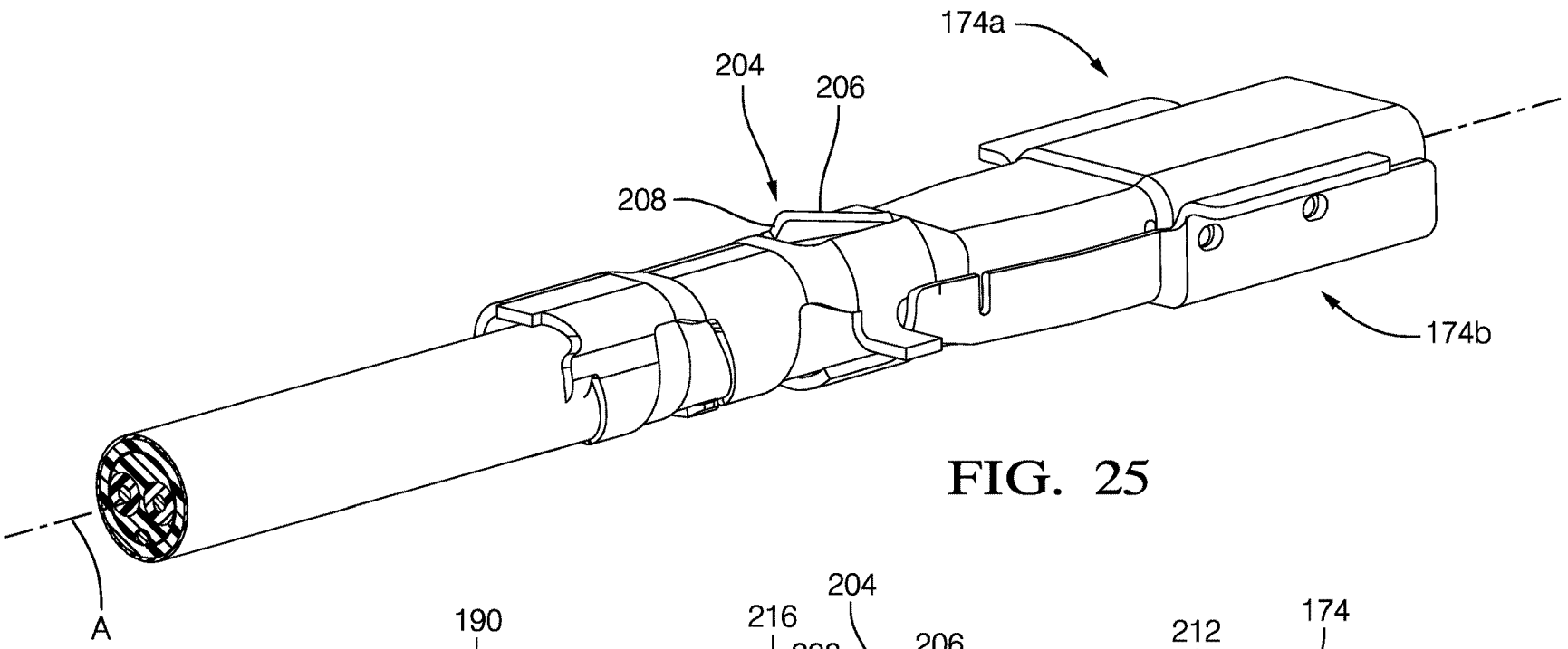
FIG. 25 is perspective view of the receptacle connector shield assembly of the wire cable assembly of FIG. 12 in accordance with the sixth embodiment.
Figure 26:
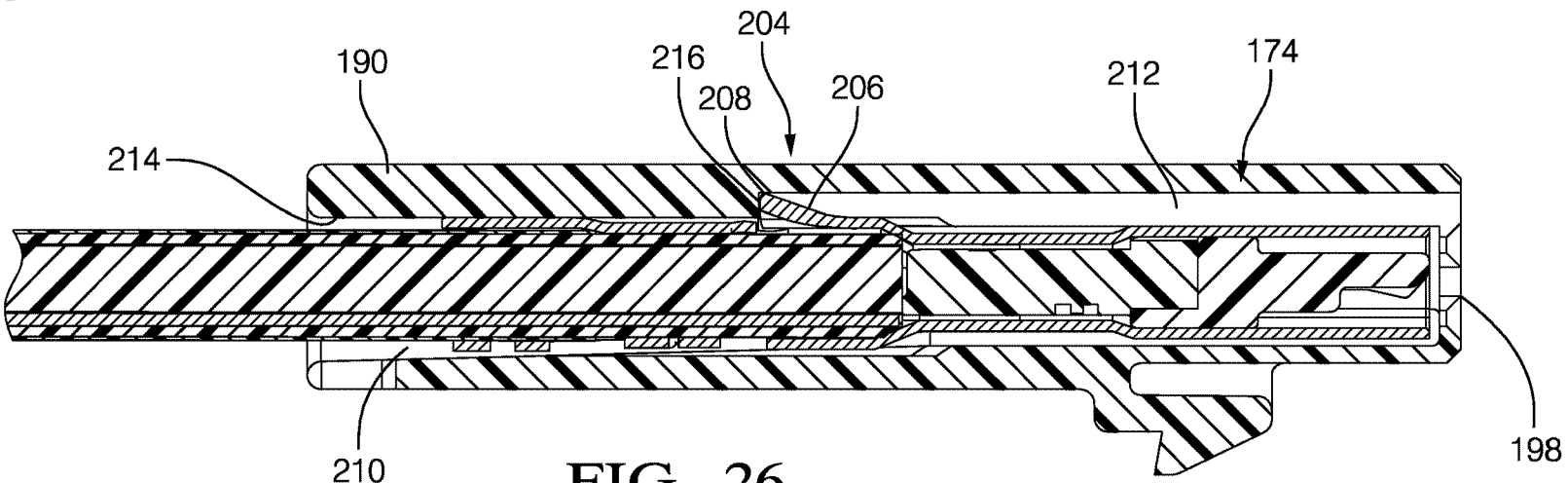
FIG. 26 is a cross sectional view of the receptacle connector body of the wire cable assembly of FIG. 12 in accordance with the sixth embodiment.

As illustrated in FIG. 25, the first receptacle shield 174*a* defines a triangular lock tang 204 that protrudes from the first receptacle shield 174*a* and is configured to secure the receptacle connector shield assembly 130 within the cavity 198 of the receptacle connector body 190. The lock tang 204 includes a fixed edge (not shown) that is attached to the first receptacle shield 174*a* and is substantially parallel with a longitudinal axis A of the receptacle shield 174, a leading edge 206 that is unattached to the first receptacle shield 174*a* and defines an acute angle relative to the longitudinal axis A, and a trailing edge 208 that is also unattached to the first receptacle shield 174*a* and is substantially perpendicular to the longitudinal axis A. The leading edge 206 and the trailing edge 208 protrude from the first receptacle shield 174*a*. As illustrated in FIG. 26, the cavity 198 of the receptacle connector body 190 includes a narrow portion 210 and a wide portion 212. When the receptacle connector shield assembly 130 is initially inserted into the narrow portion 210, the leading edge 206 of the lock tang 204 contacts a top wall 214 of the narrow portion 210 and compresses the lock tang 204, allowing the receptacle connector shield assembly 130 to pass through the narrow portion 210 of the cavity 198. When the lock tang 204 enters the wide portion 212 of the cavity 198, the lock tang 204 returns to its uncompressed shape. The trailing edge 208 of the lock tang 204 then contacts a back wall 216 of the wide portion 212 of the cavity 198, inhibiting the receptacle connector shield assembly 130 from passing back through the narrow portion 210 of the receptacle connector body cavity 198. The lock tang 204 may be compressed so that the receptacle connector shield assembly 130 may be removed from the cavity 198 by inserting a pick tool in the front of the wide portion 212 of the cavity 198.

Figure 27:
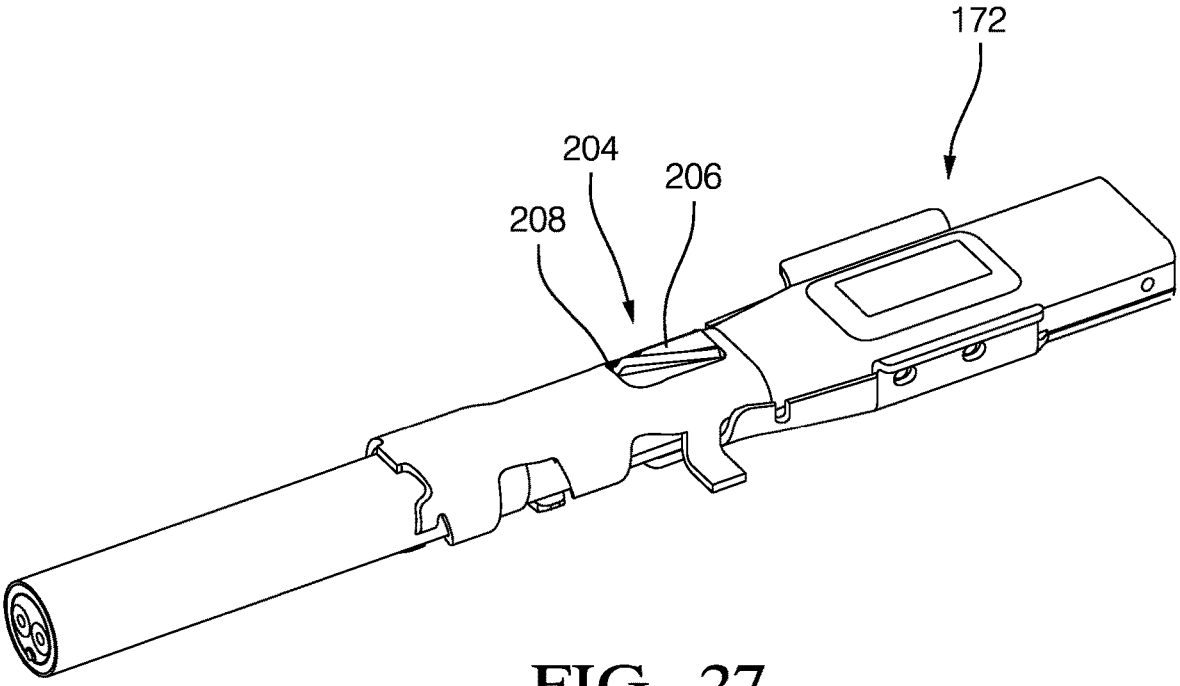
FIG. 27 is perspective view of the plug connector shield assembly of the wire cable assembly of FIG. 12 in accordance with the sixth embodiment.

As shown in FIG. 27, the first plug shield 172*a* defines a similar lock tang 204 configured to secure the plug connector shield assembly 128 within the cavity 194 of the plug connector body 192. The cavity 194 of the plug connector body 192 includes similar wide and narrow portions that have similar top walls and back walls. The lock tang 204 may be formed during the stamping process of forming the first plug shield 172*a* and the first receptacle shield 174*a*.

Referring once again to FIG. 12, the second receptacle shield 174*b* also includes a pair of protrusions 218 configured to interface with a pair of grooves 220 defined in the side walls of the plug cavity 194 to align and orient the plug connector shield assembly 128 within the cavity 194 of the plug connector body 192. The second plug shield 172*b* similarly defines a pair of protrusions 218 configured to interface with a pair of grooves (not shown due to drawing perspective) defined in the side walls of the receptacle cavity 198 to align and orient the receptacle connector shield assembly 130 within the cavity 198 of the receptacle connector body 190.

While the examples of the receptacle and plug connector bodies 190, 192 illustrated in FIG. 12 include only a single cavity, other embodiments of the connector bodies may be envisioned that include a plurality of cavities so that the connector bodies include multiple plug and receptacle connector shield assemblies 128, 130 or alternatively contain other connector types in addition to the plug and receptacle connector shield assemblies 128, 130.

Figure 28:
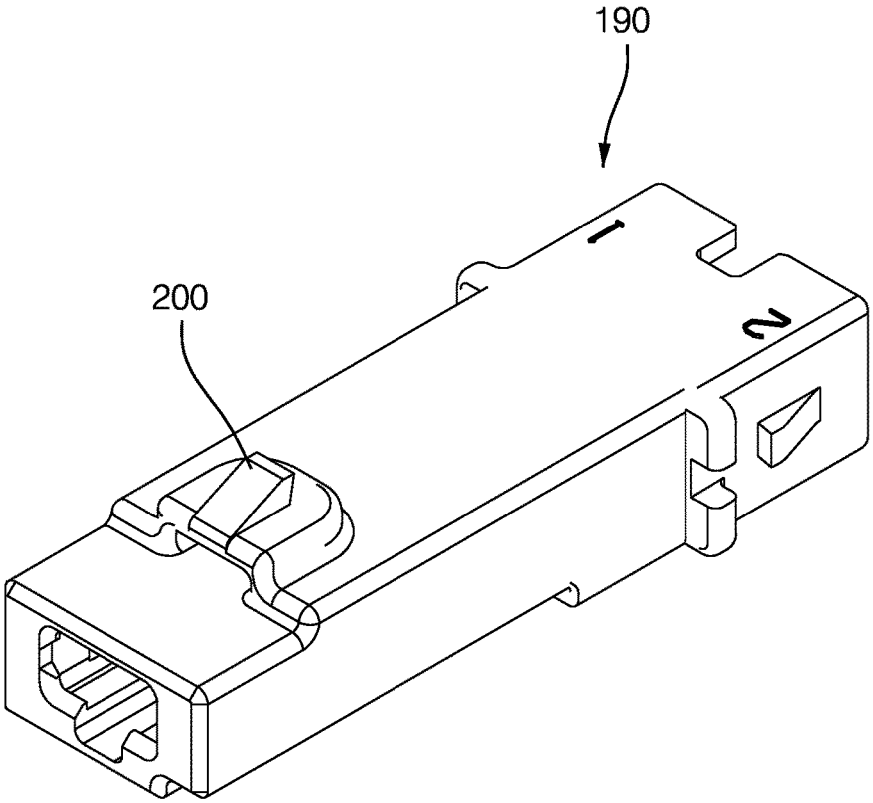
FIG. 28 is a perspective view of the receptacle connector body of the wire cable assembly of FIG. 12 in accordance with the sixth embodiment.

As illustrated in FIG. 28, the receptacle connector body 190 defines the lock tab 200 that extends outwardly from the receptacle connector body 190.

Figure 29:
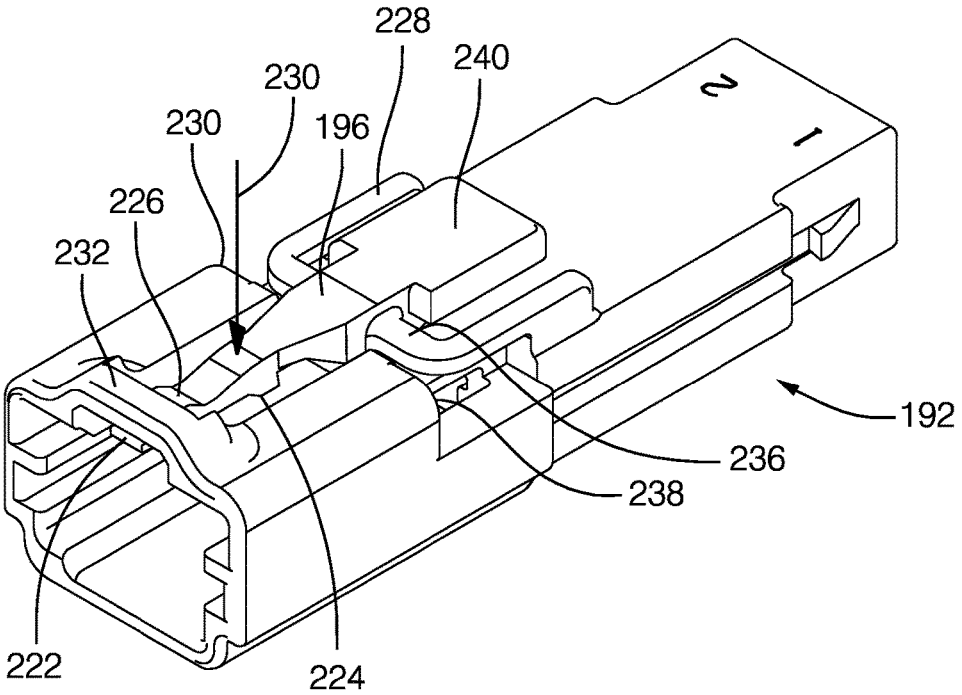
FIG. 29 is a perspective view of the plug connector body of the wire cable assembly of FIG. 12 in accordance with the sixth embodiment.

As illustrated in FIG. 29, the plug connector body 192 includes a longitudinally extending lock arm 196. A free end 222 of the lock arm 196 defines an inwardly extending lock nib 224 that is configured to engage the lock tab 200 of the receptacle connector body 190. The free end 222 of the lock arm 196 also defines an outwardly extending stop 226. The lock arm 196 is integrally connected to the socket connector body by a resilient U-shaped strap 228 that is configured to impose a hold-down force 230 on the free end 222 of the lock arm 196 when the lock arm 196 is pivoted from a state of rest. The plug connector body 192 further includes a transverse hold down beam 232 integrally that is connected to the plug connector body 192 between fixed ends and configured to engage the stop 226 when a longitudinal separating force 234 applied between the receptacle connector body 190 and the plug connector body 192 exceeds a first threshold. Without subscribing to any particular theory of operation, when the separating force 234 is applied, the front portion 236 of the U-shaped strap 228 is displaced by the separating force 234 until the stop 226 on the free end 222 of the lock arm 196 contacts the hold down beam 232. This contact between the stop 226 and the hold down beam 232 increases the hold-down force 230 on the lock nib 224, thereby maintaining engagement of the lock nib 224 with the lock tab 200, thus inhibiting separation of the plug connector body 192 from the receptacle connector body 190.

The plug connector body 192 further comprises a shoulder 238 that is generally coplanar with the U-shaped strap 228 and is configured to engage the U-shaped strap 228. Without subscribing to any particular theory of operation, when the separating longitudinal force applied between the receptacle connector body 190 and the plug connector body 192 exceeds a second threshold, the front portion 236 of the U-shaped strap 228 is displaced until the front portion 236 contacts the face of the shoulder 238 and thereby increases the hold-down force 230 on the lock nib 224 to maintain the engagement of the lock nib 224 with the lock tab 200. The separating force 234 at the second threshold is greater than the separating force 234 at the first threshold. Because the stop 226 and the U-shaped strap 228 help to increase the hold-down force 230, it is possible to provide a connector body having a low-profile locking mechanism that is capable of resisting a separating force using a polyester material that can meet automotive standards.

Figure 30:
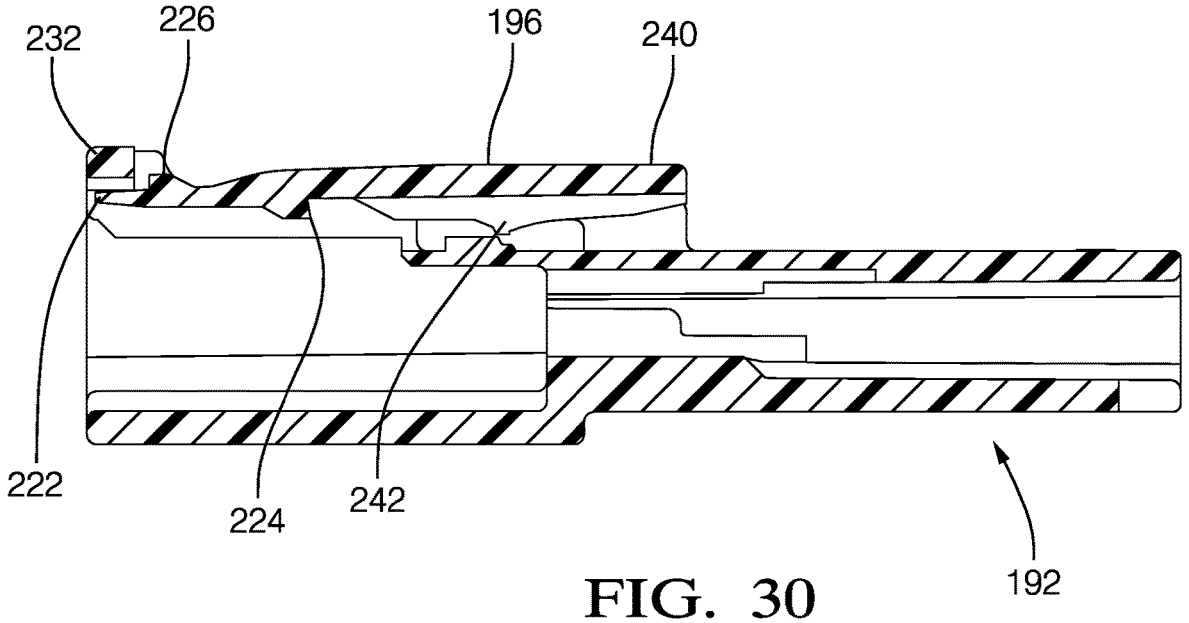
FIG. 30 is cross sectional view of the plug connector of the wire cable assembly of FIG. 12 in accordance with the sixth embodiment.
Figure 31:
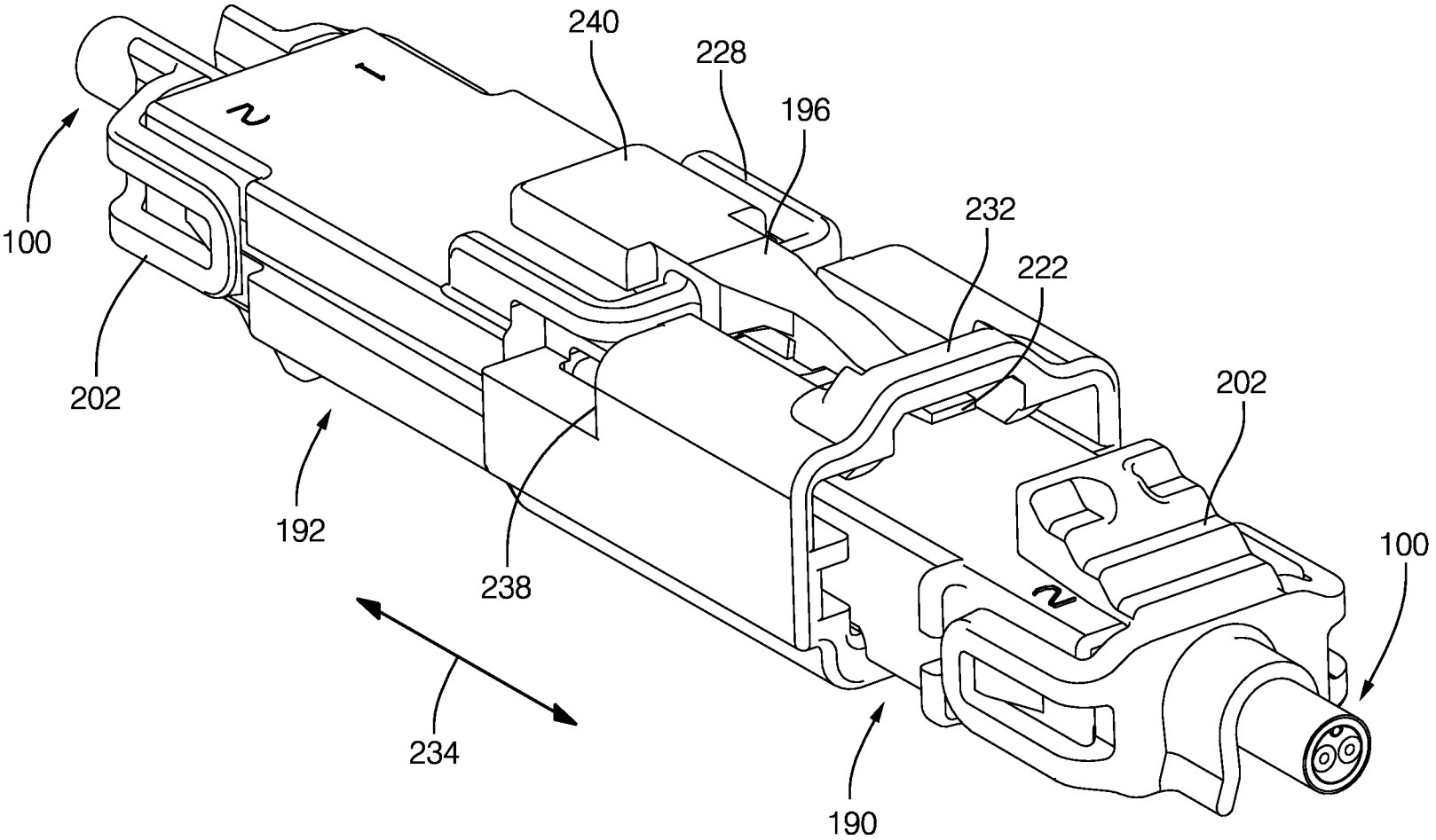
FIG. 31 is a perspective view of the wire cable assembly of FIG. 12 in accordance with the sixth embodiment.
Figure 32:
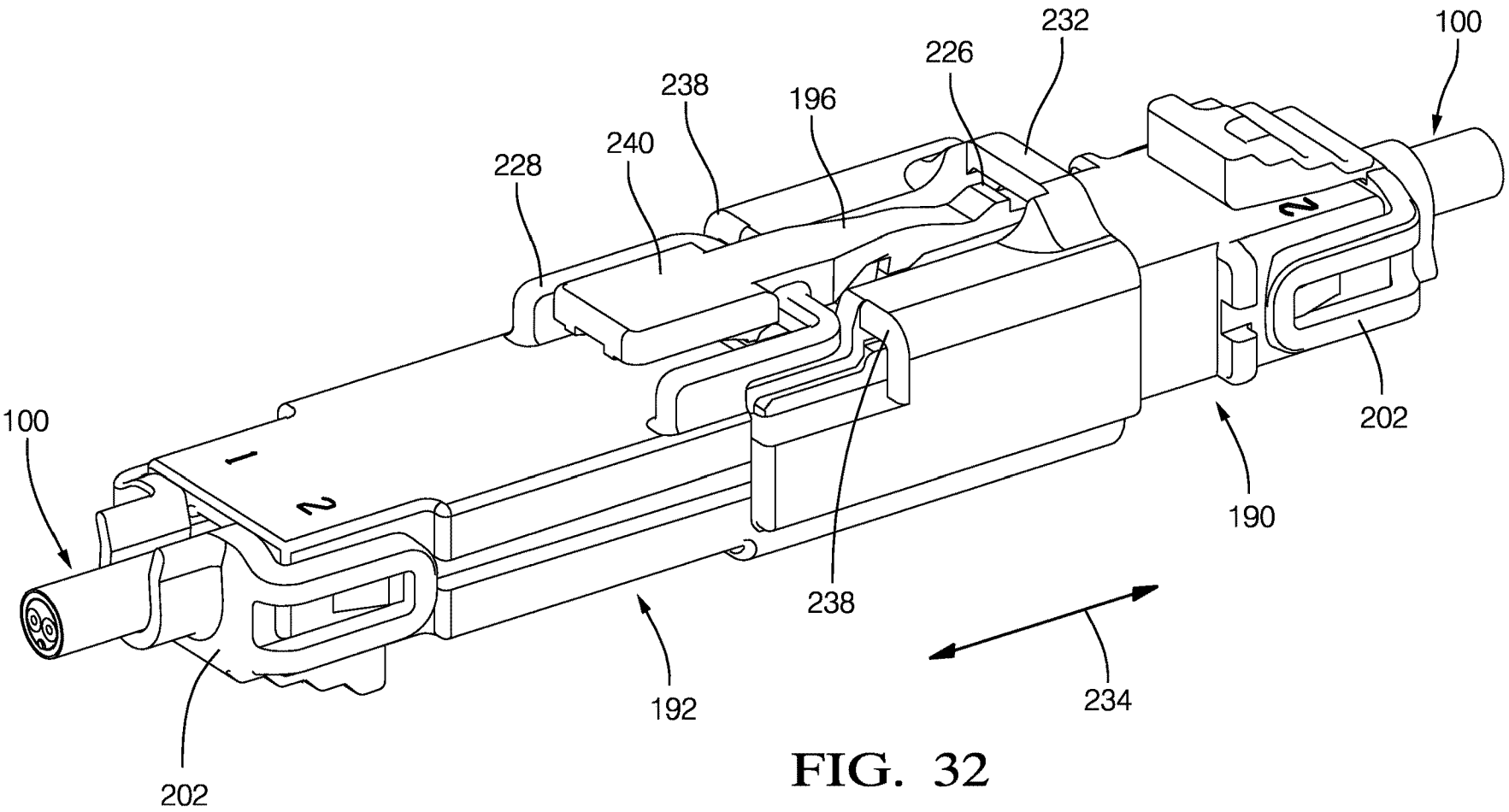
FIG. 32 is an alternative perspective view of the wire cable assembly of FIG. 12 in accordance with the sixth embodiment.
Figure 33:
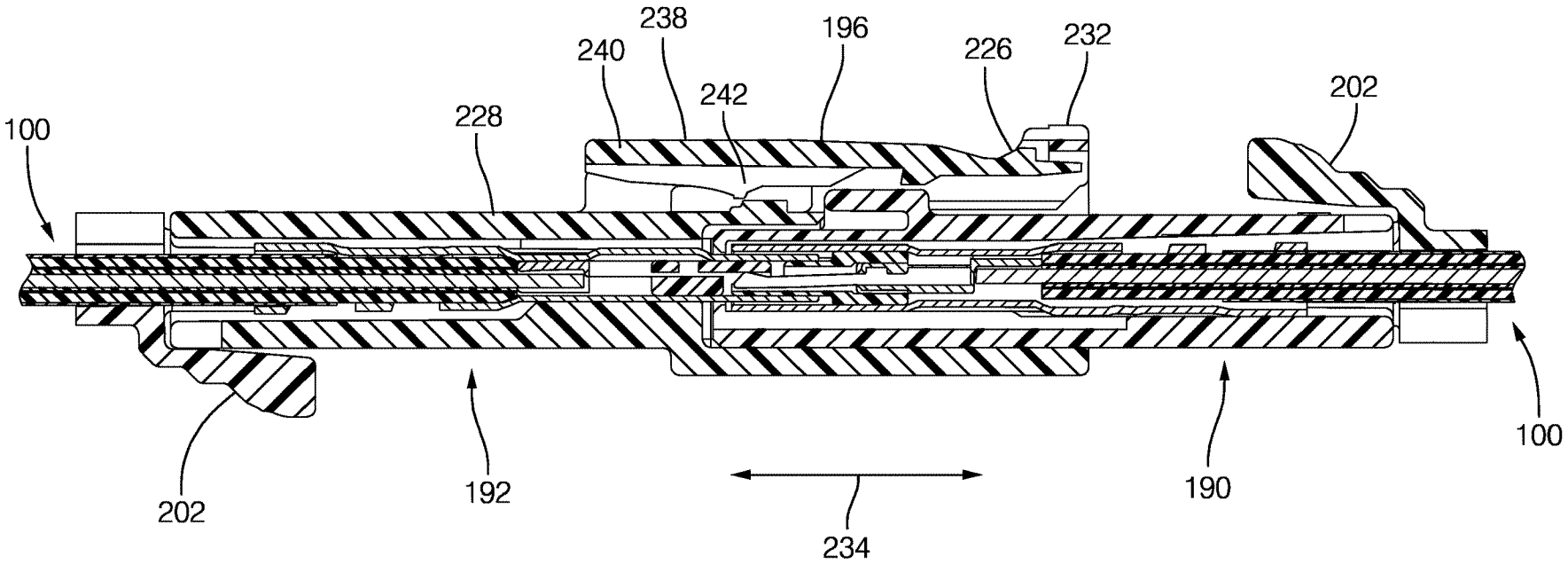
FIG. 33 is a cross sectional view of the wire cable assembly of FIG. 12 in accordance with the sixth embodiment.

The lock arm 196 also includes a depressible handle 240 that is disposed rearward of the U-shaped strap 228. The lock nib 224 is moveable outwardly away from the lock tab 200 by depressing the handle to enable disengagement of the lock nib 224 with the lock tab 200. As illustrated in FIG. 30, the lock arm 196 further includes an inwardly extending fulcrum 242 disposed between the lock nib 224 and the depressible handle 240.

Figure 34:
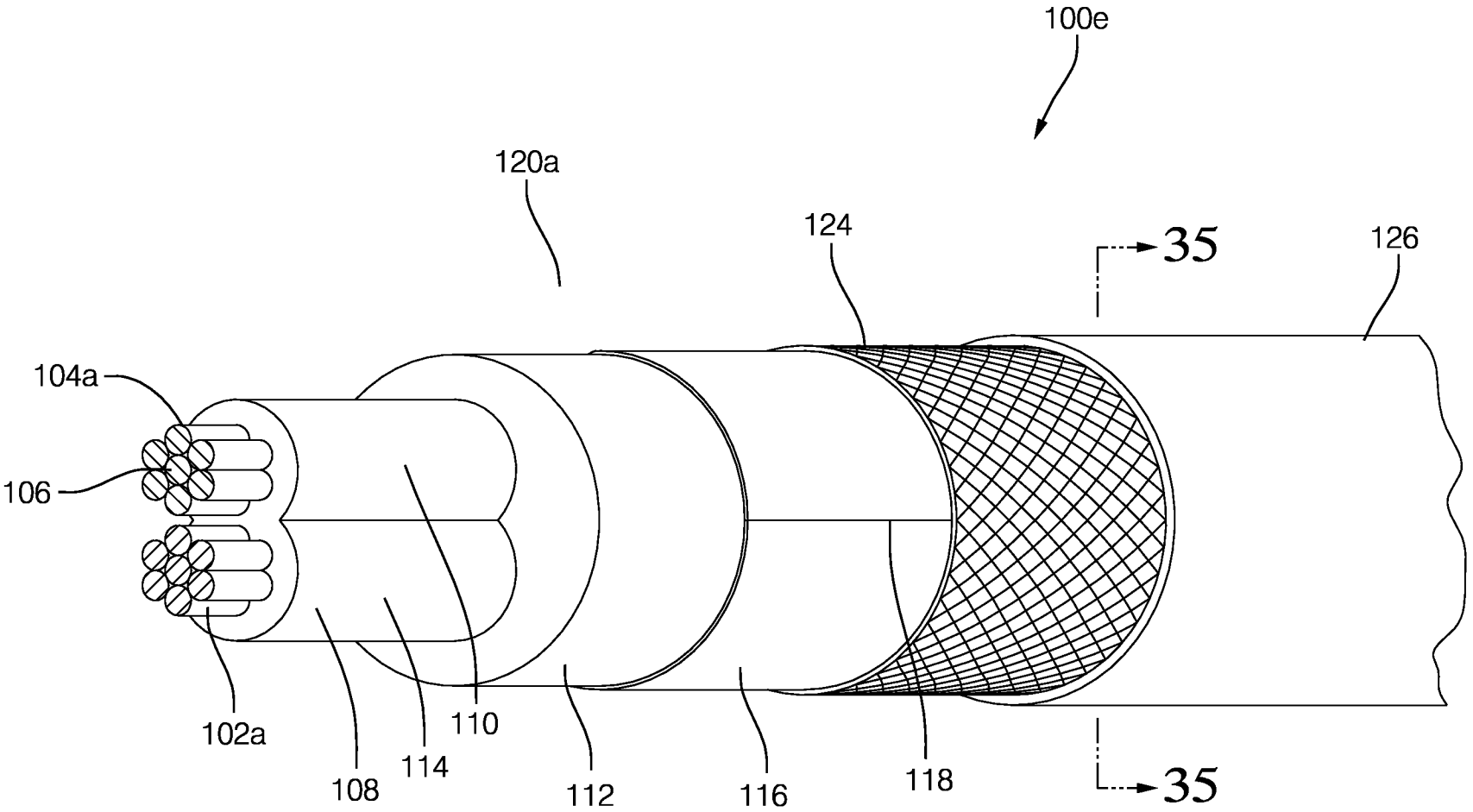
FIG. 34 is perspective cut away drawing of a wire cable of a wire cable assembly having stranded conductors in accordance with a seventh embodiment.
Figure 35:
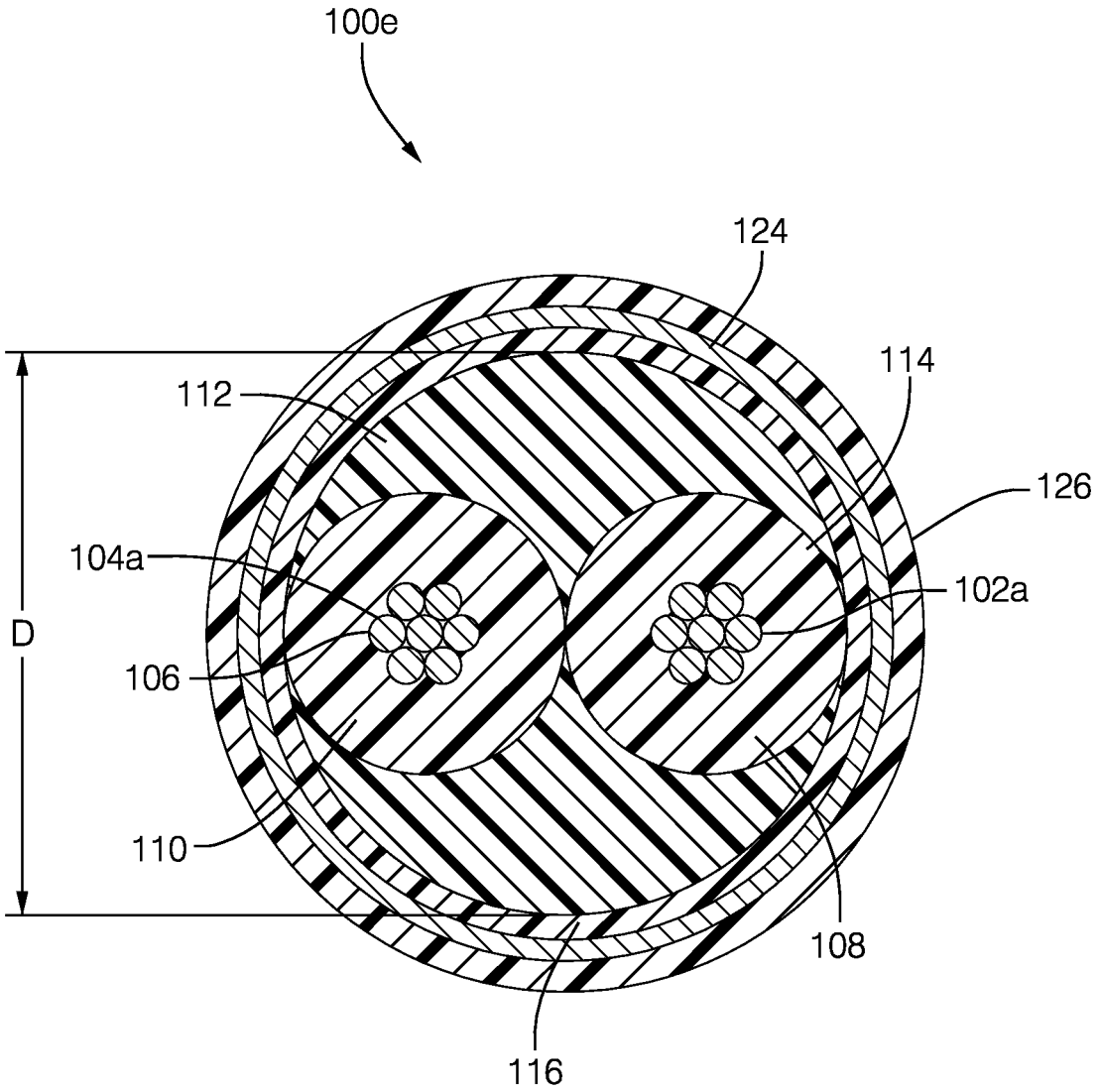
FIG. 35 is a cross section drawing of the wire cable of FIG. 34 in accordance with the seventh embodiment.
Figure 36:
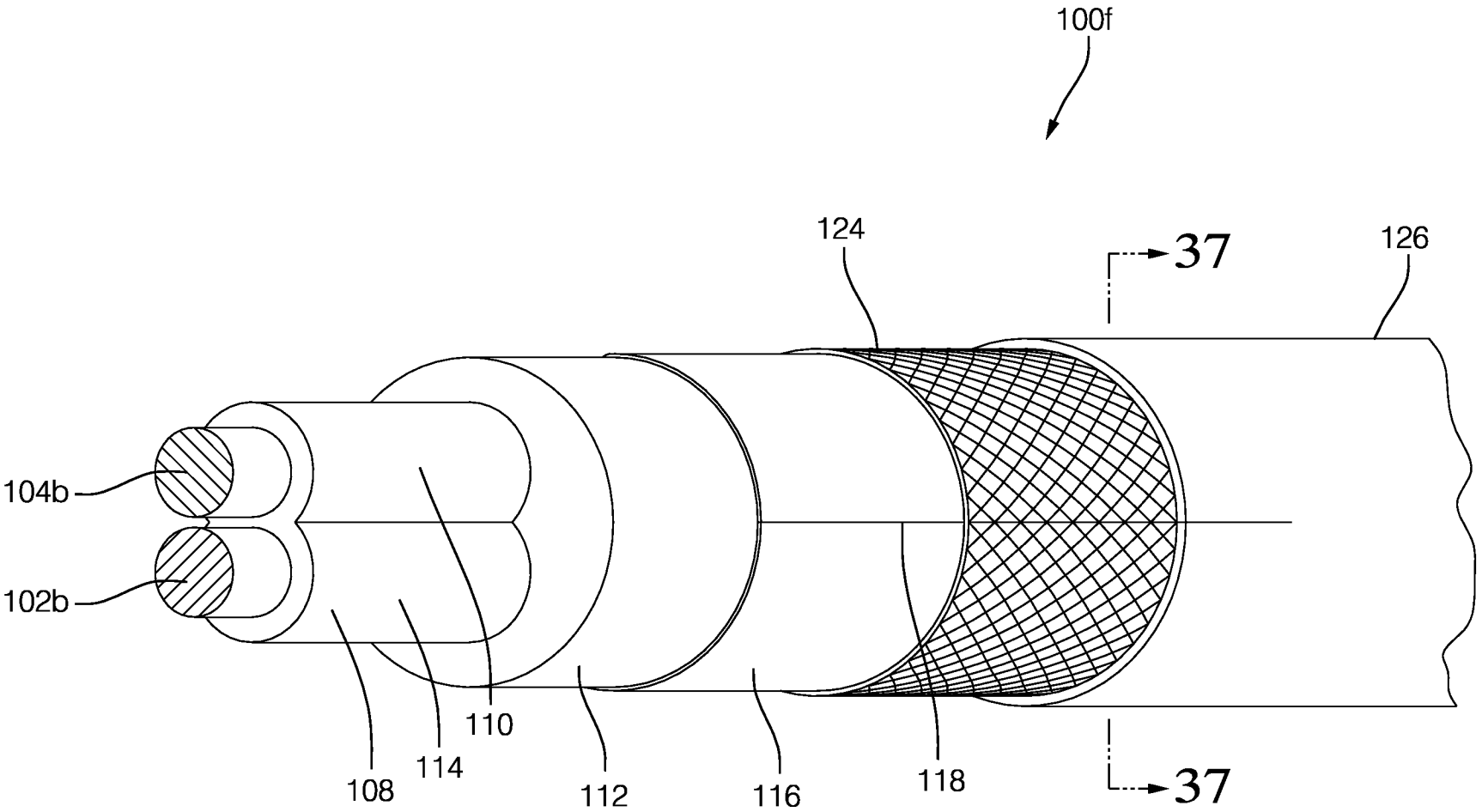
FIG. 36 is perspective cut away drawing of a wire cable of a wire cable assembly having solid conductors in accordance with an eighth embodiment.
Figure 37:
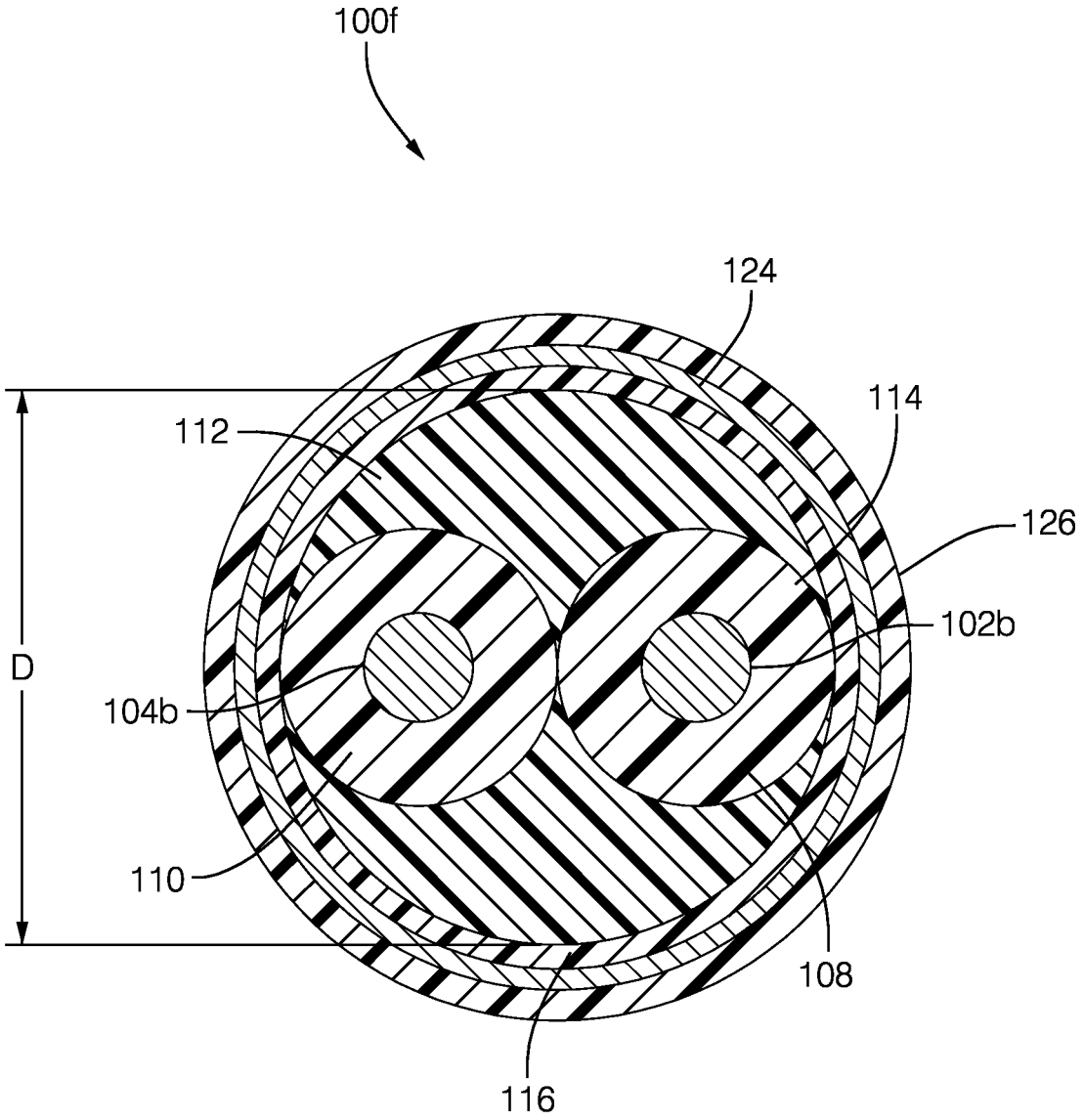
FIG. 37 is a cross section drawing of the wire cable of FIG. 36 in accordance with the eighth embodiment.

The inventors have discovered that a wire cable assembly that does not include a drain wire, such as wire cable assembly 100*e* illustrated in FIGS. 34 and 35 and wire cable assembly 100*f* illustrated in FIGS. 36 and 37 is capable of meeting the performance characteristics shown in FIGS. 9-11. Elimination of the drain wire connection allows for improved shielding and controlled impedance. The consistency of the original cable shield construction is maintained throughout the connection, thereby improving repeatability and reliability of the system. Elimination of the drain wire connection allows for higher data transfer speeds. Present drain wire connections that are implemented inside of the shield may cause transmission line imbalance of the data pair, limiting the upper data rate.

As illustrated in FIGS. 34 and 35, wire cable assembly 100*e* includes first and second conductors 102*a*, 104*a* that consist of seven wire strands 106. Each of the wire strands 106 of the first and second conductors 102*a*, 104*a* may be characterized as having a diameter of 0.12 millimeters (mm). The first and second conductors 102*a*, 104*a* may be characterized as having an overall diameter of about 0.321 millimeters (mm), which is generally equivalent to 28 American Wire Gauge (AWG) stranded wire. Alternatively, the first and second conductors 102*a*, 104*a* may be formed of stranded wire having a smaller diameter, resulting in a smaller overall diameter equivalent to 30 AWG or 32 AWG. The construction of wire cable assembly 100*e* is basically identical to the construction of wire cable assembly 100*a* with the exception of the drain wire 120.

As illustrated in FIGS. 36 and 37, wire cable assembly 100*f* includes first and second conductors 102*b*, 104*b* that each comprise a solid wire conductor, such as a bare (non-plated) copper wire or silver plated copper wire having a diameter of about 0.321 millimeters (mm), which is generally equivalent to 28 AWG solid wire. Alternatively, the first and second conductors 102*b*, 104*b* may be formed of a solid wire having a smaller gauge, such as 30 AWG or 32 AWG. The construction of wire cable assembly 100*f* is basically identical to the construction of wire cable assembly 100*b* with the exception of the drain wire 120.

Accordingly, a wire cable assembly 100*a*-100*f* is provided. The wire cable 100*a*-100*f* is capable of transmitting digital data signals with data rates of 3.5 Gb/s or higher without modulation or encoding. The wire cable 100*a*-100*c* and 100*e*-100*f* is capable of transmitting signals at this rate over a single pair of conductors rather than multiple twisted pairs as used in other high speed cables capable of supporting similar data transfer rates, such as Category 7 cable. Using a single pair as in wire cable 100*a*-100*c* and 100*e*-100*f* provides the advantage of eliminating the possibility for cross talk that occurs between twisted pairs in other wire cables having multiple twisted pairs. The single wire pair in wire cable 100*a*-100*c* and 100*e*-100*f* also reduces the mass of the wire cable; an important factor in weight sensitive applications such as automotive and aerospace. The belting 112 between the first and second conductors 102*a*, 104*a*, 102*b*, 104*b* and the inner shield 116 maintains transmission line characteristics and keeps a consistent radial distance between the first and second conductors 102*a*, 104*a*, 102*b*, 104*b* and the inner shield 116 especially when the cable is bent as is required in routing the wire cable 100*a*-100*c* within an automotive wiring harness assembly. Maintaining the consistent radial distance between the first and second conductors 102*a*, 104*a*, 102*b*, 104*b* and the inner shield 116 controls cable impedance and provides reliable data transfer rates. The belting 112 and the bonding of the first and second insulators 108, 110 helps to maintain the twist lay length between the first and second conductors 102*a*, 104*a*, 102*b*, 104*b* in the wire pair, again, especially when the cable is bent by being routed through the vehicle at angles that would normally induce wire separation between the first and second conductor 102, 104. This also provides controlled cable impedance. The plug connectors 128 and receptacle connectors 130 cooperate with the wire cable to provide controlled cable impedance. Therefore, it is a combination of the elements, such as the bonding of the first and second insulators 108, 110 and the belting 112, the inner shield 116, the terminals 132, 134, 160, 162 and not any one particular element that provides a wire cable assembly 100*a*-100*c* and 100*e*-100*f* having consistent impedance and insertion loss characteristic that is capable of transmitting digital data at a speed of 3.5 Gb/s or more, even when the wire cable 100*a*-100*c* and 100*e*-100*f* is bent.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An assembly configured to transmit electrical signals, comprising:

a wire cable having a first inner conductor and a second inner conductor, both having a generally round cross section and having an overall diameter in a range of 0.203 mm to 0.321 mm;

a shield surrounding the first inner conductor and the second inner conductor; and a dielectric structure having an at least nearly round cross section comprising a first dielectric insulator enclosing the first inner conductor and a second dielectric insulator enclosing the second inner conductor, wherein the first and second dielectric insulators are formed of polypropylene and have a thickness of about 0.85 mm, said dielectric structure configured to maintain a first predetermined spacing between the first inner conductor and the second inner conductor, a second predetermined spacing between the first inner conductor and the shield and a third predetermined spacing between the second inner conductor and the shield, wherein the first dielectric insulator is integral with the second dielectric insulator and the first dielectric insulator and the second dielectric insulator are bonded together, thereby providing lateral spacing between the first inner conductor and the second inner conductor, wherein the dielectric structure further comprises a third dielectric insulator enclosing the first dielectric insulator and the second dielectric insulator, wherein the third dielectric is formed of polyethylene and has a diameter of about 2.2 mm, and wherein the shield comprises an inner shield conductor at least partially enclosing the dielectric structure, thereby establishing a characteristic impedance of the wire cable, wherein the inner shield conductor is formed of an aluminized biaxially oriented polyethylene terephthalate film having a thickness of less than or equal to 0.04 mm, and an outer shield conductor at least partially enclosing the inner shield conductor and in electrical communication with the inner shield conductor, wherein the wire cable has a characteristic impedance of 95 Ohms and an intra-pair skew of less than 50 picoseconds.

2. The assembly according to claim 1, wherein said assembly does not include a separate drain wire conductor.

3. The assembly according to claim 1, wherein the inner shield conductor is formed of the aluminized biaxially oriented polyethylene terephthalate film wrapped about the dielectric structure such that a seam formed by the inner shield conductor is substantially parallel to a longitudinal axis of the wire cable and wherein a lateral length of the inner shield conductor covers at least 100 percent of a dielectric structure circumference.

4. The assembly according to claim 1, wherein the first inner conductor and the second inner conductor are not twisted one about the other.

5. The assembly according to claim 1, wherein the wire cable is characterized as having a differential insertion loss of less than 1.5 decibels (dB) for a signal with signal frequency content less than 100 Megahertz (MHz), less than 5 dB for a signal with signal frequency content between 100 MHz and 1.25 Gigahertz (GHz), less than 7.5 dB for a signal with signal frequency content between 1.25 GHz and 2.5 GHz, and less than 25 dB for a signal with signal frequency content between 2.5 GHz and 7.5 GHz when having a length of 7 meters or less.

6. The assembly according to claim 1, wherein the outer shield conductor is formed of a plurality of woven conductors having a thickness that is less than or equal to 0.30 mm and wherein the outer shield conductor is in contact with at least 65 percent of an outer surface of the inner shield.

7. The assembly according to claim 6, wherein the outer shield conductor is contained within a jacket formed of a polyvinyl chloride material having a thickness of about 0.2 mm.

8. The assembly according to claim 1, wherein the assembly further comprises at least one electrical connector selected from a group consisting of a plug connector and a receptacle connector has:

wherein the plug connector has:

a first plug terminal including a first connection portion characterized by a generally rectangular cross section, and a second plug terminal including a second connection portion characterized by a generally rectangular cross section, wherein the first and second plug terminals are configured to be attached to the first and second inner conductor respectively and wherein the first and second plug terminals form a mirrored pair having bilateral symmetry about a longitudinal axis of the wire cable; and wherein the receptacle connector configured to mate with said plug connector has:

a first receptacle terminal including a first cantilever beam portion characterized by a generally rectangular cross section and defining a convex first contact point depending from the first cantilever beam portion, said first contact point configured to contact the first connection portion of the first plug terminal, and a second receptacle terminal including a second cantilever beam portion characterized by a generally rectangular cross section and defining a convex second contact point depending from the second cantilever beam portion, said second contact point configured to contact the second connection portion of the second plug terminal, wherein the first and second receptacle terminals are configured to be attached to the first and second inner conductor respectively, wherein the first and second receptacle terminals form a mirrored terminal pair having bilateral symmetry about the longitudinal axis and wherein when the plug connector is connected to the receptacle connector, a major width of the first connection portion is substantially perpendicular to a major width of the first cantilever beam portion, and a major width of the second connection portion is substantially perpendicular to a major width of the second cantilever beam portion.

9. The assembly according to claim 8, wherein the assembly further comprises at least one electrically conductive shield selected from a group consisting of a plug shield and a receptacle shield has:

wherein the plug shield electrically isolated from the plug connector and longitudinally surrounding the plug connector; and wherein the receptacle shield electrically isolated from the receptacle connector and longitudinally surrounding the receptacle connector, wherein the electrically conductive shield defines a pair of wire crimping wings that are mechanically connected to the outer shield conductor, thereby electrically connecting the electrically conductive shield to the inner shield conductor, thereby establishing the characteristic impedance of the assembly.

10. The assembly according to claim 9, wherein the receptacle shield defines an embossment proximate a location of a connection between the first inner conductor and the first receptacle terminal and a connection between the second inner conductor and the second receptacle terminal.

11. The assembly according to claim 10, wherein the assembly having the wire cable up to 7 meters in length is characterized as having a differential insertion loss of less than 1.5 dB for a signal with signal frequency content less than 100 MHz, less than 5 dB for a signal with signal frequency content between 100 MHz and 1.25 GHz, less than 7.5 dB for a signal with signal frequency content between 1.25 GHz and 2.5 GHz, and less than 25 dB for a signal with signal frequency content between 2.5 GHz and 7.5 GHz.

12. The assembly according to claim 9, wherein the electrically conductive shield defines a prong that is configured to penetrate the dielectric outer layer, thereby inhibiting rotation of the electrically conductive shield about the longitudinal axis.

13. The assembly according to claim 9, wherein the assembly further comprises at least one connector body selected from a group consisting of a plug connector body and a receptacle connector body has:

wherein the plug connector body defining a first cavity, wherein said plug connector and said plug shield are at least partially disposed within said first cavity, and wherein the receptacle connector body defining a second cavity and configured to mate with the plug connector body, wherein said receptacle connector and said receptacle shield are at least partially disposed within said second cavity.

14. The assembly according to claim 13, wherein the plug shield defines a first triangular protrusion configured to secure the plug shield within the plug connector body and the receptacle shield defines a second triangular protrusion configured to secure the receptacle shield within the receptacle connector body.

15. The assembly according to claim 13, wherein the plug connector body defines a longitudinally extending lock arm integrally connected to the plug connector body, said lock arm including a U-shaped resilient strap integrally connecting the lock arm to the plug connector body, an inwardly extending lock nib configured to engage an outwardly extending lock tab defined by the receptacle connector body, a depressible handle disposed rearward of the U-shaped resilient strap, wherein the lock nib is moveable outwardly away from the lock tab to enable disengagement of the lock nib with the lock tab, an inwardly extending fulcrum located between the lock nib and the depressible handle, a free end defining an outwardly extending stop, a transverse hold down beam integrally connected to the plug connector body between fixed ends and configured to engage the stop and increase a hold-down force on the lock nib to maintain engagement of the lock nib with the lock tab when a longitudinal force applied between the plug connector body and the receptacle connector body exceeds a first threshold.

* * * * *